US007240899B2

(12) United States Patent
Amamoto

(10) Patent No.: US 7,240,899 B2
(45) Date of Patent: Jul. 10, 2007

(54) SHEET FEEDING DEVICE AND SHEET PROCESSING APPARATUS

(75) Inventor: Hidekazu Amamoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 233 days.

(21) Appl. No.: 10/715,517

(22) Filed: Nov. 19, 2003

(65) Prior Publication Data

US 2004/0251600 A1 Dec. 16, 2004

(30) Foreign Application Priority Data

May 9, 2003 (JP) ..... P 2003-132029
May 9, 2003 (JP) ..... P 2003-132062

(51) Int. Cl.
*B65H 1/08* (2006.01)

(52) U.S. Cl. ..... 271/126

(58) Field of Classification Search ..... 271/126, 271/127, 157, 160, 24, 30.1, 128
See application file for complete search history.

(56) References Cited

U.S. PATENT DOCUMENTS 5,954,327 A * 9/1999 Lin et al. ..... 271/110
6,942,212 B2 * 9/2005 Koh ..... 271/156

FOREIGN PATENT DOCUMENTS

| | | |
|---|---|---|
| JP | 5-4733 | 1/1993 |
| JP | 5-229674 | 9/1993 |
| JP | 11-29226 | 2/1999 |
| JP | 2003-182861 | 7/2003 |

* cited by examiner

*Primary Examiner*—Patrick Mackey
*Assistant Examiner*—Thomas Morrison
(74) *Attorney, Agent, or Firm*—Morgan, Lewis & Bockius LLP

(57) ABSTRACT

A sheet feeding device includes an elastic support member, a following movable member disposed so as to contact an uppermost sheet of a stack of sheets stacked on a sheet tray and can follow and move in accordance with the change in the stacking amount of the sheets, a restraining mechanism that restrains the elastic support member in accordance with the stacking amount of the sheets so that the position of the uppermost sheet is held at a substantial constant, and a release mechanism that interlocks with the movement of the following movable member to release the restrained state. The restraining mechanism includes an engagement member that moves together with the elastic support member and a restraining member that restrains the movement of the engagement member. The restraining member moves along a straight locus at least near an engaging portion to engage with and disengage from the engagement member.

31 Claims, 31 Drawing Sheets

SHEET FEEDING DEVICE AND SHEET PROCESSING APPARATUS

The present disclosure relates to the subject matter contained in Japanese Patent Application No. 2003-132092 filed May 9, 2003, and Japanese Patent Application No. 2003-132062 filed May 9, 2003, which are incorporated herein by reference in their entirety.

BACKGROUND OF THE INVENTION

1. Field of the Invention

The present invention relates to a sheet feeding device used in a sheet processing apparatus such as a copier or a printer, and in particular to the improvement of a sheet feeding device and a sheet processing apparatus using the same in which a stack of sheets lifted up by an elastic support member is successively fed beginning with the uppermost sheet.

2. Description of the Related Art

Generally, a sheet processing apparatus such as a copier or a printer is ordinarily disposed with a sheet feeding device that feeds sheets, such as paper sheets, to an image forming section serving as a sheet processing section. An image formed in the image forming section is transferred to the sheets.

Conventionally, as this kind of sheet feeding device, there has been a device that includes a sheet tray in which the sheets are accommodated, a sheet feeding unit is disposed above the sheet tray, and the sheets are successively fed by this sheet feeding unit from above.

Here, as the sheet feeding unit, a unit disposed with a pickup roll for sending the sheets and a separating mechanism (e.g., configured by a feed roll and a retard roll) that separates the sent sheets one sheet at a time is often used.

Incidentally, in this type of sheet feeding device, a bottom plate lift system is used in order to feed the sheets in the sheet tray.

The bottom plate lift system is a system where a bottom plate is liftable disposed at the bottom portion of the sheet tray and the sheets are pushed up and supported by the bottom plate, whereby the uppermost sheet is pushed against the pickup roll of the sheet feeding unit, the sheet is sent by the pickup roll, and thereafter the sent sheets are guided to the separating mechanism so that they are separated one sheet at a time.

JP-A-5-4733 (Examples, FIG. 5), JP-A-5-229674 (Configuration of the Invention, FIG. 1) and JP-A-11-29226 (Embodiments of the Invention, FIG. 1) disclose such a configuration.

With respect to this type of bottom plate lift system, technology has already been proposed where a drive source such as a motor and a driving force transmission mechanism for transmitting the driving force from the drive source to the bottom plate are disposed, and in which the bottom plate is lifted up in accordance with the remaining amount of the sheets stacked on the bottom plate (e.g., see JP-A-5-4733 and JP-A-5-229674). However, the drive source such as the motor, the driving force transmission mechanism and a sheet remaining amount detection system are required, which results in the system becoming expensive.

Also, technology has already been proposed where the drive source such as a motor is replaced with an elastic member such as a spring (e.g., see JP-A-11-29226). However, when handling sheets of various sizes and quality, the lift amount of the bottom plate becomes uneven due to differences in sheet weight, and the sheet feeding operation by the pickup roll easily become unstable.

Thus, in order to effectively eliminate this drawback, the lift amount of the bottom plate must be minutely controlled, and there has been the technical problem that this control mechanism ends up being complicated.

SUMMARY OF THE INVENTION

The present invention has been made to solve the above technical problem, and it is an object thereof to provide a sheet feeding device and a sheet processing apparatus using the same which can achieve stabilization of the sheet feeding operation with a simple configuration.

According to an aspect of the present invention, there is provided a sheet feeding device comprising: a sheet tray on which sheets are stacked; an elastic support member that lifts up and supports, with the elastic force of an elastic member, the stack of sheets stacked on the sheet tray; a sheet feeding unit that successively feeds, beginning with the uppermost sheet, the stack of sheets lifted up by the elastic support member; a following movable member which is disposed so as to contact the uppermost sheet of the stack of sheets stacked on the sheet tray and which follows and moves in accordance with the change in the stacking amount of the sheets; a restraining mechanism that restrains the elastic support member in accordance with the stacking amount of the sheets so that the position of the uppermost sheet of the stack of sheets stacked on the sheet tray is held at a substantial constant, the restraining mechanism including an engagement member that moves together with the elastic support member and a restraining member that restrains the movement of the engagement member; and a release mechanism that interlocks with the movement of the following movable member to release the restrained state resulting from the restraining mechanism; wherein the restraining member moves along a straight locus at least in the vicinity of an engaging portion between the engagement member and the restraining member so as to engage with and disengage from the engagement member.

DESCRIPTION OF THE INVENTION

Figure 1:
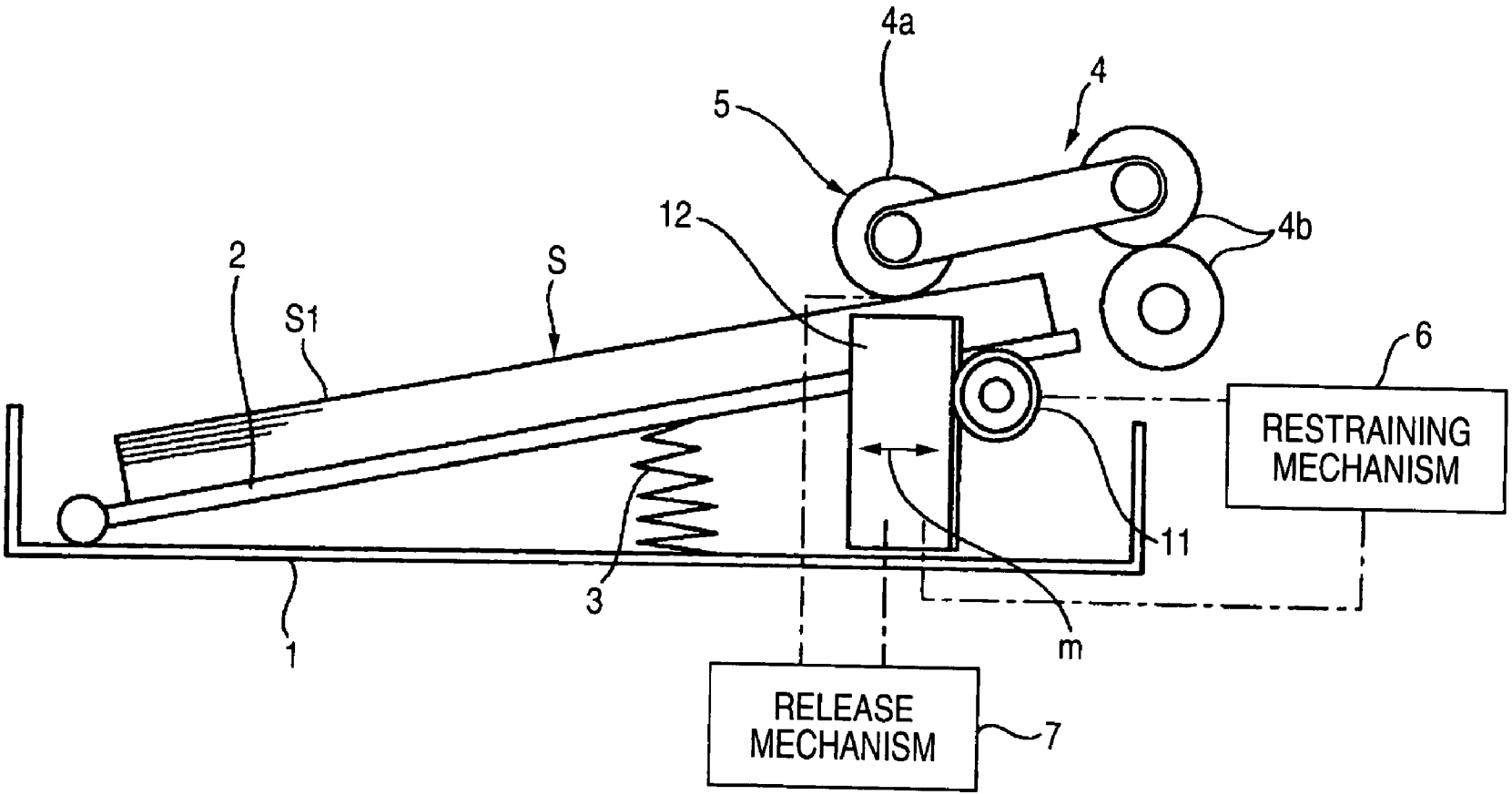
FIG. 1 is an explanatory view showing an overall sheet feeding device according to an embodiment of the invention.

One aspect of the present invention provides, as shown in FIG. 1, a sheet feeding device including: a sheet tray 1 on which sheets S are stacked; an elastic support member 2 that lifts up and supports, with the elastic force of an elastic member 3, the stack of sheets S stacked on the sheet tray 1; a sheet feeding unit 4 that successively sends, beginning with the uppermost sheet S1, the stack of sheets S lifted up by the elastic support member; a following movable member 5 which is disposed so as to contact the uppermost sheet S1 of the stack of sheets S stacked on the sheet tray 1 and which follows and moves in accordance with the change in the stacking amount of the sheets S; a restraining mechanism 6 that restrains the elastic support member 2 in accordance with the stacking amount of the sheets S so that the position of the uppermost sheet S1 of the stack of sheets S stacked on the sheet tray 1 is held at a substantial constant; and a release mechanism 7 that interlocks with the movement of the following movable member 5 to release the restrained state resulting from the restraining mechanism 6, wherein the restraining mechanism 6 includes an engagement member 11 that moves together with the elastic support member 2 and a restraining member 12 that restrains the movement of the engagement member 11, with the restraining member 12 moving along a straight locus m at least in the vicinity of the engaging portion of both so as to engage with and disengage from the engagement member 11.

In this technical means, devices that feed sheets S are widely included in the sheet feeding device of the invention. For example, the invention can be applied to a pullout type (so-called cassette type) disposed with a sheet tray 1 that can be pulled out from the apparatus body, a manual-feed type, and a document feeding device capable of setting documents.

Also, the elastic support member 2 may include a movable bottom plate urged by the elastic member 3, may be a support member supporting a movable bottom plate urged by the elastic member 3, and may be a support member urged by the elastic member 3 without using a movable bottom plate.

With respect to the bottom plate serving as the elastic support member 2, it is not invariably necessary for the entire region thereof to have a plate shape as long as it has a plate shape on which the sheets Scan be stacked, and cutouts or openings may be appropriately disposed.

Moreover, the elastic support member 2 may be a member that is elastically urged by the elastic member 3 such as a spring or the like. Although an example in which the elastic support member 2 is raised by a drive mechanism using a drive source such as a motor without using the elastic member 3 is excluded, an example using a drive mechanism using a drive source in addition to the elastic member 3 is not invariably excluded. For example, an example in which the elastic support member 2 is lowered by the drive mechanism in the direction counter to the urging direction of the elastic member 3 is included. It should be noted that the number and disposed place of the elastic member 3 may be appropriately selected.

Although the sheet feeding unit 4 preferably includes at least a sheet feeding member 4*a*, ordinarily there are many instances in which it includes a separating mechanism 4*b* where the sheets S sent by the sheet feeding member 4*a* are separated one sheet at a time.

The sheet feeding member 4*a* may have a roll shape or may be a belt wound around rolls. As long as the sheet feeding member is a member having the function of sending the uppermost sheet S1, the design thereof may be appropriately changed.

As long as the separating mechanism 4*b* is a mechanism that separates the sheets S one sheet at a time, the separating mechanism 4*b* may be any type, for example, may be a type in which a feed member (roll, belt, etc.) And a retard member (roll, pad, etc.) Are combined.

Also, the following movable member 5 widely includes members that are disposed so as to contact the uppermost sheet S1 of the stack of sheets S stacked on the sheet tray 1 and move and follow the change in the stacking amount of the sheets S. From the standpoint of simplifying the device configuration, examples thereof include the sheet feeding member 4*a* that configures part of the sheet feeding unit 4 and is disposed so as to contact the uppermost sheet S1 of the stack of sheets S stacked on the sheet tray 1. However, the following movable member 5 is not limited thereto and may be disposed separately from the sheet feeding member 4*a*.

In this case, from the standpoint of being able to reduce as much as possible frictional resistance when the sheets S are fed, it is preferable for the following movable member 5 to be disposed with a rotating body that is rotatable.

The restraining mechanism 6 may be appropriately selected as long as it can restrain the position of the elastic support member 2 so that the position of the uppermost sheet S1 of the stack of sheets S stacked on the sheet tray 1 is held at a substantial constant.

In this case, when the position of the uppermost sheet S1 is substantially constant, the relative positional relationship between the sheet feeding unit 4 and the uppermost sheet S1 becomes constant and, as a result, the nipping pressure of the sheet feeding member 4*a* with respect to the uppermost sheet S1 becomes constant and the sending operation of the sheets S is stabilized.

Examples of restraining mechanism 6 include an example in which the restraining mechanism 6 includes an engagement member 11 that moves together with the elastic support member 2 and a restraining member 12 that restrains the movement of the engagement member 11.

The engagement member 11 may move together with the elastic support member 2, maybe directly disposed at the elastic support member 2, or may be disposed via a drive transmission system such as gears with respect to the elastic support member 2. Also, the locus of movement of the engagement member 11 may be a linear or a curved locus.

Also, although it suffices for the restraining member 12 to be able to restrain the movement of the engagement member 11, it is preferable for the restraining member 12 to be disposed with an urging member urging the restraining member 12 towards the engagement member 11 from the standpoint of stabilizing the engaged state with the engagement member 11.

Moreover, specific examples of the engagement member 11 and the restraining member 12 include an example in which the engagement member 11 is a gear where teeth are formed at least on part of a peripheral surface thereof, and the restraining member 12 is a rack on which at least one tooth that meshes with the gear is formed.

As a preferable example of the locus of movement of the restraining member 12, an example in which the restraining member 12 moves along a straight locus m near at least the engaging portion of both so as to engage with and disengage from the engagement member 11 is preferable.

By defining the locus as the "straight locus m", the restraining and releasing operations between the restraining member 12 and the engagement member 11 are stabilized.

Here, because the locus is the "straight locus m", a "curved locus" (swinging rotation) is excluded. Also, although the entire locus of movement of the "restraining member 12" may be the straight locus m, it is preferable for the entire locus to be the straight locus m near at least the engaging portion between the restraining member 12 and the engagement member 11 because the engagement and disengagement operations between the restraining member 12 and the engagement member 11 can be conducted smoothly.

Examples of the drive format of the restraining member 12 include an example in which the restraining member 12 includes driven portions at at least two places and simultaneously drives both driven portions when moving. According to this example, the restraining member 12 can be stably operated in a case where, for example, the restraining member 12 is moved along the straight locus m.

Moreover, in the drive format of this type of restraining member 12, an urging member is disposed at the restraining member 12 in order to stabilize the engaged state between the restraining member 12 and the engagement member 11, and the urging member urges a substantially intermediate portion between the driven portions disposed at the two places with respect to the restraining member 12.

Moreover, with respect to the restraining mechanism 6 comprising a gear that is the engagement member 11 and a rack that is the restraining member 12, the teeth of both are involute teeth, with the pressure angle thereof being 8 to 12 degrees. According to this example, damage resulting from tooth skipping can be effectively circumvented.

Also, the release mechanism 7 may be configured so that, when the stacking amount of the sheets S is reduced, the following movable member 5 is lowered and the restrained state of the restraining mechanism 6 is released in accompaniment therewith.

Examples of the release mechanism 7 include an example in which the release mechanism 7 includes: a release operational member that moves together with the following movable member 5; a contact interlocking member that abuts against and interlocks with the release operational member; and a coupling member that is disposed between the contact interlocking member and the restraining mechanism 6 and releasably couples the restraining mechanism.

In this type of example, as the coupling member, there is a member that is a gear train that meshes with the driven portions of the restraining mechanism, with the contact interlocking member being coupled to one of the gears of the gear train.

As a preferable example in terms of reducing the release force resulting from the release mechanism 7, the gear train that is the coupling member is one in which the number of teeth of each gear is set so that the rotational force of the gear coupled to the contact interlocking member is amplified and transmitted to the driven portions of the restraining mechanism 6. According to this example, it is possible to amplify and transmit the driving force with the coupling member, and it is possible to reduce the release force.

Moreover, as shown in FIG. 1, in an example including the restraining mechanism 6 and the release mechanism 7, the sheet feeding device may be configured to include a guide mechanism by which the locus of movement of the elastic support member is guided, from the standpoint of stabilizing the movement of the elastic support member 2.

The restraining mechanism 6 may include the engagement member 11 comprising a gear that moves together with the elastic support member 2 and the restraining member 12 comprising a rack that restrains the movement of the engagement member 11, the guide mechanism may include a guide gear that is disposed separately from the gear of the restraining mechanism 6 at the elastic support member 2 and a guide rack that meshes with the guide gear and guides the locus of movement of the elastic support member 2, and the module of the gear that is the engagement member 11 of the restraining mechanism 6 may be set to be smaller than that of the guide gear.

According to this example, by setting the module of the gear of the restraining mechanism 6 to be small, the precision of sheet position control is improved and tooth skipping of the guide gear can be prevented.

For example, the gear module of the restraining mechanism 6 is set to 0.5 and the module of the guide gear is set to 0.8.

Also, the restraining mechanism 6 may comprise the engagement member 11 and the restraining member 12, and as a preferable attachment structure of the engagement member 11, the engagement member 11 may be attached to the elastic support member 2 via a one-way clutch.

Moreover, the sheet feeding device preferably includes a buffer member in which a buffering force is imparted to the movement of the elastic support member 2, with the buffer member being attached to the elastic support member 2 via a one-way clutch.

In this type, it is preferable for the one-way clutch to be one whose coupling is cut when the elastic support member 2 is lowered, from the standpoint of reducing the operational force when the elastic support member 2 is returned to the return position.

Figure 31:
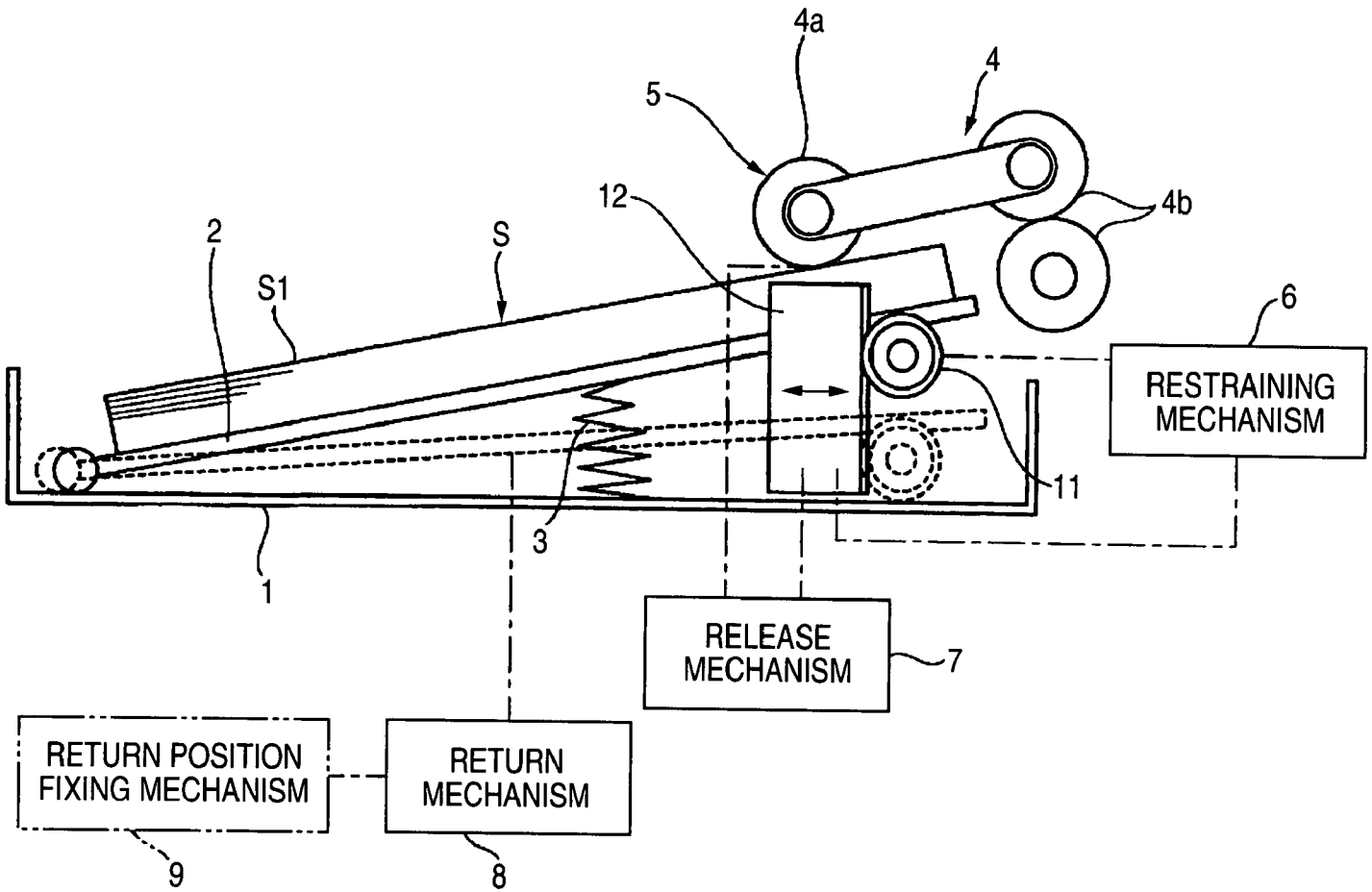
FIG. 31 is an explanatory view showing an overall sheet feeding device according to another embodiment of the invention.

Another aspect of the present invention provides, as shown in FIG. 31, a sheet feeding device including: a sheet tray 1 on which sheets S are stacked; an elastic support member 2 that lifts up and supports, with the elastic force of an elastic member 3, the stack of sheets S stacked on the sheet tray 1; a sheet feeding unit 4 that successively sends, beginning with the uppermost sheet S1, the stack of sheets S lifted up by the elastic support member 2; a following movable member 5 which is disposed so as to contact the uppermost sheet S1 of the stack of sheets S stacked on the sheet tray 1 and which follows and moves in accordance with the change in the stacking amount of the sheets S; a restraining mechanism 6 that restrains the elastic support member 2 in accordance with the stacking amount of the sheets S so that the position of the uppermost sheet S1 of the stack of sheets S stacked on the sheet tray 1 is held at a substantial constant; a release mechanism 7 that interlocks with the movement of the following movable member 5 to release the restrained state resulting from the restraining mechanism 6; and a return mechanism 8 that returns the elastic support member 2 to a return position that is a lift-up initial position of the stack of sheets S resulting from the elastic support member 2.

The return mechanism 8 is preferably one that returns the elastic support member 2 to its initial position. By returning the elastic support member 2 to its initial position, drawbacks such as the setting of the sheets S being difficult or the stack of sheets S being lifted up when a pullout type sheet tray 1 is loaded into the device and the uppermost sheet S1 getting caught in the device can be eliminated.

Examples of this type of return mechanism 8 include a return mechanism disposed with a return-use engagement member at the elastic support member and a pushdown mechanism by which the return-use engagement member is forcibly pushed down. In this case, although the pushdown mechanism is necessary in a pullout type sheet feeding device and a fixed type sheet feeding device, it does not have to invariably be interlocked with the pullout operation of the sheet tray 1 in, for example, a pullout sheet feeding device. The pushdown mechanism may be made to work after the sheet tray 1 has been pulled out.

Also, as a representative example of the return mechanism 8 in the pullout type sheet feeding device, it is preferable for the return mechanism 8 to interlock with the pullout operation of the sheet tray 1 to return the elastic support member 2 to the return position.

Also, as a representative example of the pushdown mechanism in the pullout type sheet feeding device, it is preferable for the pushdown mechanism to be a cam that is disposed at the device body, interlocks with the pullout operation of the sheet tray 1, engages with the return-use engagement member and forcibly pushes down the return-use engagement member.

Moreover, in the invention, the sheet feeding device preferably includes a return position fixing mechanism 9 that releasably fixes the elastic support member 2 at the return position.

With only the return mechanism 8, there is the concern that the elastic support member 2 will end up moving from the return position if the restraining mechanism 6 is inadvertently released. However, by adding the return position fixing mechanism 9, the elastic support member 2 does not move from the return position as long as this is not released.

As a representative example of the return position fixing mechanism 9, the return position fixing mechanism 9 includes: a return engagement member that is disposed at the elastic support member 2 and moves together with the elastic support member 2; a return restraining member that restrains the movement of the return engagement member with the condition that the elastic support member 2 has reached the return position; and a return release member that releases the restrained state resulting from the return restraining member.

In this example, although it suffices as long as the return restraining member can restrain the movement of the return engagement member, it is preferable for the return restraining member to include a return urging member that urges the return restraining member towards the return engagement member from the standpoint of stabilizing the engaged state with the return engagement member.

Also, as a representative example of the return engagement member and the return restraining member of the return position fixing mechanism 9, the return engagement member is a gear where teeth are formed at least on part of a peripheral surface thereof, and the return restraining member is a rack on which at least one tooth that meshes with the gear is formed.

From the standpoint of easily conducting the restraining and releasing operations resulting from this type of return position fixing mechanism 9, the return restraining member is preferably one that moves along a straight locus near at least the engaging portion of both so as to engage with and disengage from the return engagement member.

According to this example, by making the locus of movement of the return restraining member a straight locus, the restraining and releasing operations between the return restraining member and the return engagement member are made easy. Also, it is not necessary for the entire locus of movement to be a straight locus, and it suffices as long as the locus is a straight locus near at least the engaging portion of both.

Moreover, from the standpoint of ensuring fixing resulting from the return position fixing mechanism 9, the teeth of the rack that is the return restraining member and the gear that is the return engagement member are preferably saw teeth.

Also, in regard to the operational timing of the return release member, the return release member is preferably one that acts on the return restraining member in a state where preparations for sending the sheets have been concluded. As for the "state where preparations for sending the sheets have been concluded" here, in a pullout type sheet feeding device, this means a state where the sheet tray 1 has been loaded to a regular position in the device body, and in a fixed type sheet feeding device, this means a state where the sheets S have been set.

As a representative example of the return release member in the pullout type sheet feeding device, the return release member is a protruding member that is disposed at the device body and releases the restrained state of the return restraining member in a state where the sheet tray 1 has been loaded in the device body.

Moreover, as shown in FIG. 31, in an example including the restraining mechanism 6, the release mechanism 7 and the return mechanism, the sheet feeding device may be configured to include a guide mechanism by which the locus of movement of the elastic support member is guided, from the standpoint of stabilizing the movement of the elastic support member 2.

The restraining mechanism 6 may include the engagement member 11 comprising a gear that moves together with the elastic support member 2 and the restraining member 12 comprising a rack that restrains the movement of the engagement member 11, the guide mechanism may include a guide gear that is disposed separately from the gear of the restraining mechanism 6 at the elastic support member 2 and a guide rack that meshes with the guide gear and guides the locus of movement of the elastic support member 2, and the module of the gear that is the engagement member 11 of the restraining mechanism 6 may be set to be smaller than that of the guide gear.

According to this example, by setting the module of the gear of the restraining mechanism 6 to be small, the precision of sheet position control is improved and tooth skipping of the guide gear can be prevented.

For example, the gear module of the restraining mechanism 6 is set to 0.5 and the module of the guide gear is set to 0.8.

Also, in an example in which the restraining mechanism 6 comprises the engagement member 11 and the restraining member 12, as a preferable attachment structure of the engagement member 11, the engagement member 11 is preferably attached to the elastic support member 2 via a one-way clutch.

Moreover, the sheet feeding device preferably includes a buffer member where a buffering force is imparted to the movement of the elastic support member 2, with the buffer member being attached to the elastic support member 2 via a one-way clutch.

In this type, it is preferable for the one-way clutch to be one whose coupling is cut when the return mechanism 8 acts, from the standpoint of facilitating the return operation.

The present invention is not limited to the above-described sheet feeding device, but can also be applied to a sheet processing apparatus that includes a sheet processing section and incorporates the above-described sheet feeding device.

DETAILED DESCRIPTION OF THE PREFERRED EMBODIMENTS

The invention will be described in detail on the basis of embodiments with reference to the accompanying drawings.

First Embodiment

Figure 2:
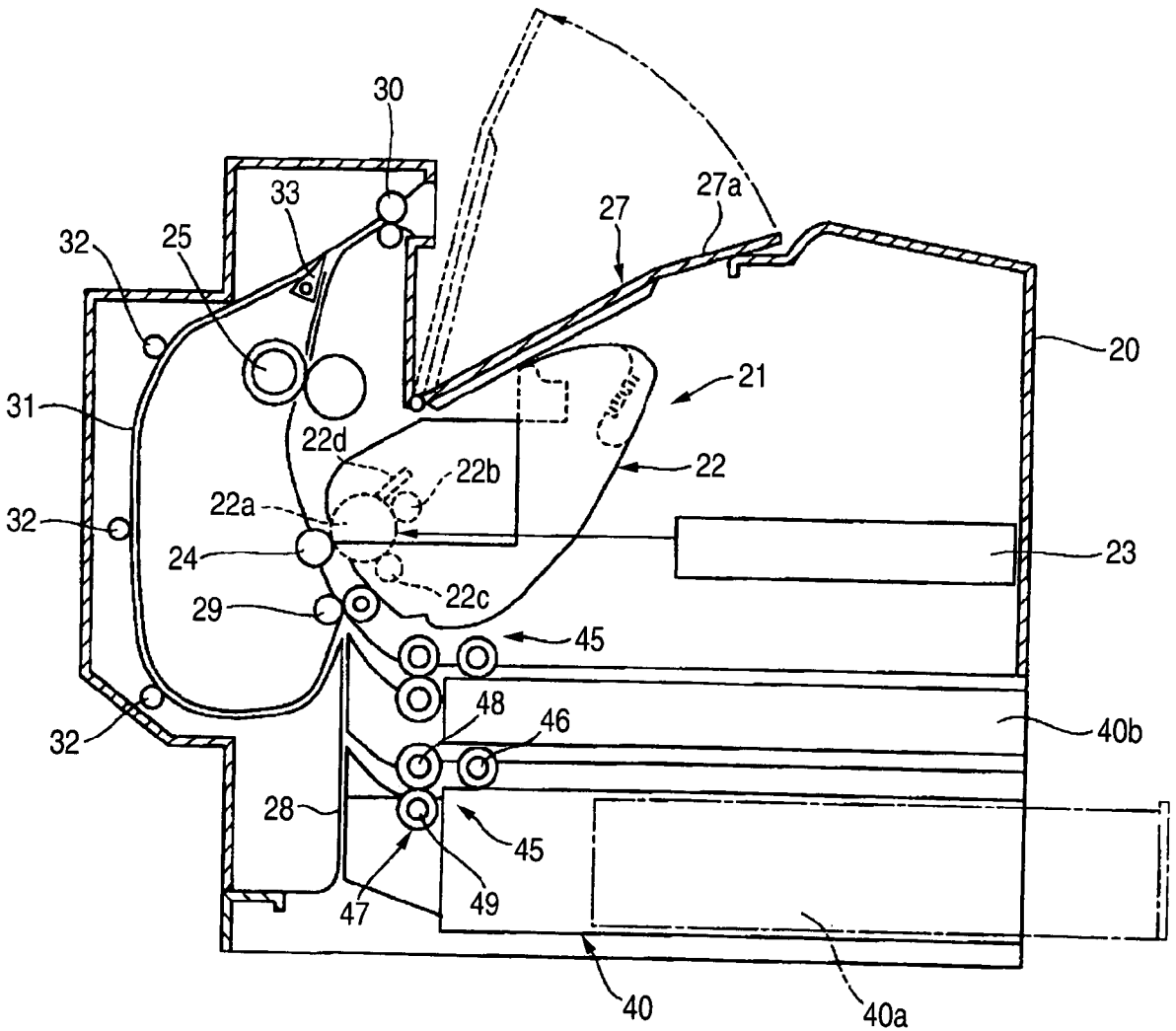
FIG. 2 is an explanatory view showing the overall configuration of a sheet processing apparatus into which a first embodiment of the sheet feeding device is incorporated.

FIG. 2 shows the overall configuration of a sheet processing apparatus into which a first embodiment of a sheet feeding device is incorporated.

In FIG. 2, the sheet processing apparatus is one in which an electrophotographic imaging engine 21 is housed inside a apparatus body 20, a sheet feeding device 40 is disposed below the imaging engine 21 inside the apparatus body 20, an upper portion of the apparatus body 20 is configured as a discharge tray 27, and a sheet conveyance path 28, along which sheets sent from the sheet feeding device 40 are guided to the imaging engine 21 and the discharge tray 27, is disposed in a substantially vertical direction at the backside (corresponding to the left side in FIG. 2) inside the apparatus body 20.

It should be noted that, although the sheet feeding device 40 in the present embodiment is incorporated inside the apparatus body 20 as a two-tier configuration (specifically, 40*a* and 40*b*), the invention is not limited thereto. The sheet feeding device 40 may also have a one-tier configuration or may have an options unit that is added to the sheet feeding device.

In the present embodiment, a process cartridge 22 in which plural electrophotographic devices are integrated is used for the imaging engine 21. The process cartridge 22 is equipped with a photosensitive drum 22*a* serving as an image retainer; a charge device 22*b* that charges the photosensitive drum 22*a*; a developing device 22*c* that visualizes, with toner, an electrostatic latent image formed on the photosensitive drum 22*a*; and a cleaning device 22*d* that cleans residual toner on the photosensitive drum 22*a*. The process cartridge 22 can be attached and detached through an opening in a cover 27*a* disposed so as to open and close the discharge tray 27.

Moreover, the imaging engine 21 is equipped with an exposure device 23 comprising, for example, a laser scanner that uses light to write the electrostatic latent image on the photosensitive drum 22*a* uniformly charged by the charging device 22*b*; a transfer device 24 comprising, for example, a transfer roll that transfers the toner image formed on the photosensitive drum 22*a* to the sheet; and a fixing device 25 that fixes, onto the sheet, the toner image transferred by the transfer device 24.

Also, in the present embodiment, a registration roll 29 for positioning and conveying the sheet is disposed upstream of the photosensitive drum 22*a* on the sheet conveyance path 28, and a discharge roll 30 is disposed near a discharge port of the sheet conveyance path 28. It should be noted that the photosensitive drum 22*a* and the transfer device (transfer roll) 24, which are positioned facing the conveyance path, and the fixing device 25 function as conveyance members.

Thus, sheets fed from the sheet feeding device 40 are positioned by the registration roll 29 of the sheet conveyance path 28, sent at a predetermined timing to an image transfer position of the process cartridge 22, where an image is transferred, and thereafter pass through the fixing device 25 and are discharged by the discharge roll 30 into the discharge tray 27.

In the present embodiment, the sheets are returned to an inverse path 31 in a double-sided recording mode.

That is, the front of the discharge roll 30 on the sheet conveyance path 28 branches into a fork, with a switching gate 33 being disposed at the branched portion and the inverse path 31 that returns to the registration roll 29 from the branched portion being formed. An appropriate number of conveyance rolls 32 are disposed on the inverse path 31.

In the double-sided recording mode, the switching gate 33 is switched to the side opening the inverse path 31, the discharge roll 30 reverses at the point in time when the front part of the trailing end of the sheet touches the discharge roll 30, and the sheet is guided to the inverse path 31. Thereafter, the reversed sheet is guided to the registration roll 29, between the photosensitive drum 22*a* and the transfer device 24, to the fixing device 25, and then to the discharge tray 27.

Figure 3:
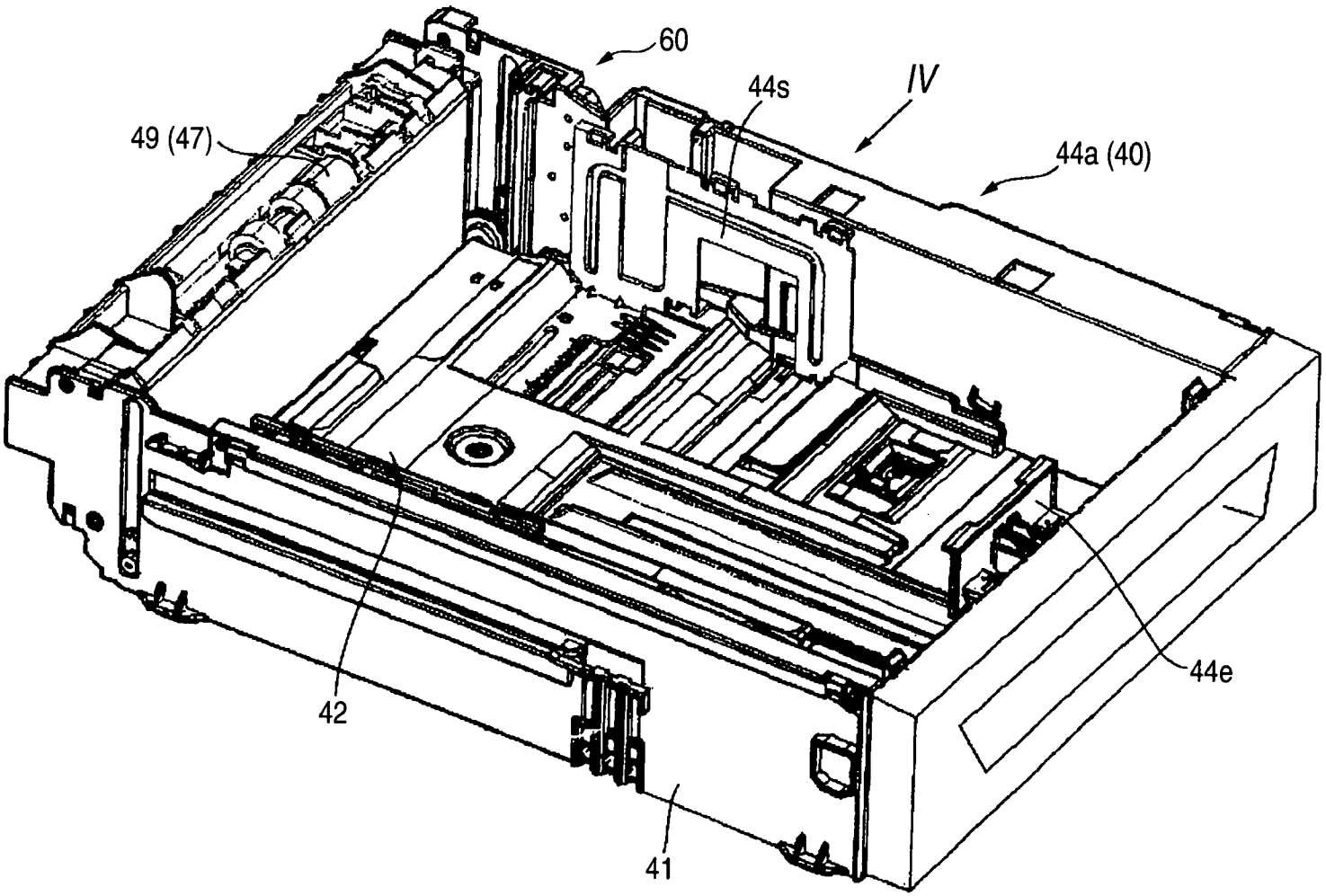
FIG. 3 is an explanatory view showing the exterior of the sheet feeding device used in the first embodiment.
Figure 4:
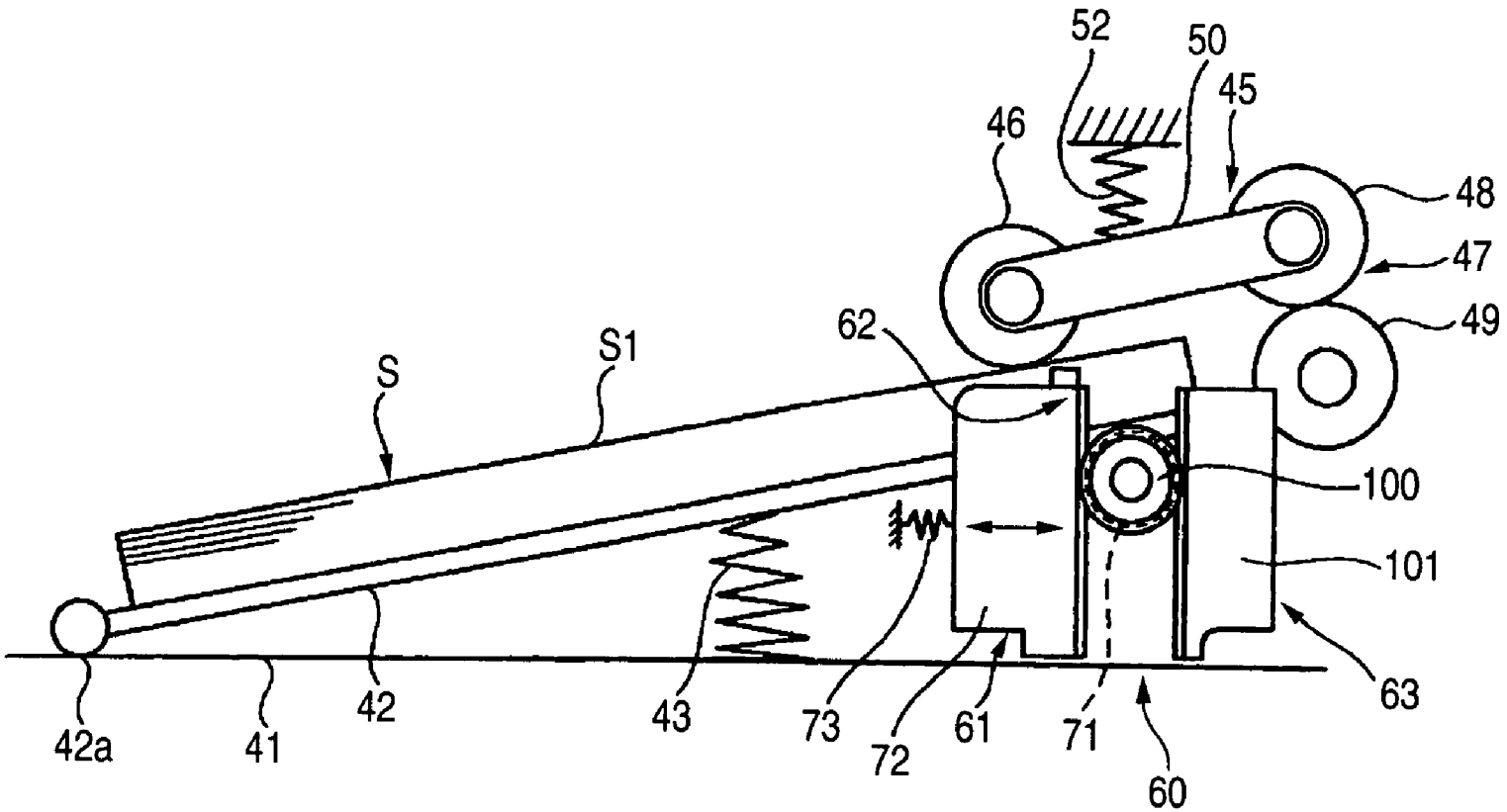
FIG. 4 is view seen from direction IV in FIG. 3.

As shown in FIGS. 2 to 4, the sheet feeding device 40 in the present embodiment is equipped with a sheet tray 41 in which the sheets S are accommodated and which is disposed so that it can be pulled out with respect to a tray receiving portion 55 (see FIG. 11) of the apparatus body 20.

A bottom plate 42 is disposed on a bottom portion of the sheet tray 41. The bottom plate 42 is disposed so as to contact the bottom portion of the sheet tray 41, with one end of the bottom plate 42 serving as a slidable pivot portion 42*a*. The bottom plate 42 is supported, at places removed from the pivot portion 42*a* (places positioned at the sheet sending direction side), by one or several elastic springs 43 (in the drawings, an example is shown where there is one).

It should be noted that the sheets S stacked on the bottom plate 42 are positioned by a pair of side guides 44*s* and an end guide 44*e*.

Moreover, a sheet feeding unit 45 is disposed above the sheet sending direction side of the sheet tray 41.

The sheet feeding unit 45 is disposed with a pickup roll 46, which is disposed so as to contact an uppermost sheet S1 of the sheets S and sends the sheet S1, and a separating mechanism 47 that separates, one sheet at a time, the sheets S sent by the pickup roll 46.

In the present example, the separating mechanism 47 is one where a feed roll 48 and a retard roll 49 are brought into contact and rotated.

Additionally, the pickup roll 46 is rotatably supported at a free end of a swinging plate 50 (see FIG. 9) which is swing able using the axis of the feed roll 48 as a swinging point. An urging force oriented downwards acts on the swinging plate 50 due to an urging spring 52, so that the pickup roll 46 is disposed so as to press against the uppermost sheet S1 with a predetermined nipping pressure. It should be noted that the urging force of the urging spring 52 is set to be smaller than the urging force of the elastic spring 43.

The urging spring 52 is not invariably necessary. The invention may also be configured so that the pickup roll 46 is disposed so as to press against the uppermost sheet S1 with a predetermined nipping pressure due to the self-weight of the swinging plate 50. In a case where the pickup roll 46 is disposed so as to press against the uppermost sheet S1 due to the self-weight of the swinging plate 50, the nipping pressure is made constant, which is preferable.

Particularly in the present embodiment, an interlocking mechanism 60 that regulates the movement of the bottom plate 42 in accordance with the stacking amount of the sheets S is disposed at the sheet sending direction side of the sheet tray 41.

In the present embodiment, as shown in FIGS. 4 to 7, the interlocking mechanism 60 includes a restraining mechanism 61 that restrains the movement of the bottom plate 42 in accordance with the stacking amount of the sheets S so that the position of the uppermost sheet S1 of the stack of sheets S stacked on the sheet tray 41 is held at a substantial constant; a release mechanism 62 that interlocks with the movement of the pickup roll 46 to release the restrained state resulting from the restraining mechanism 61; and a guide mechanism 63 by which the locus of movement of the bottom plate 42 is guided.

The restraining mechanism 61 is one in which a rotating shaft 70 is rotatably disposed at the free end of the bottom plate 42 opposite from the pivot portion 42*a*, an engagement gear 71 is fixed at a position to one side of the rotating shaft 70 separated a certain extent from the axial end, a restraining rack 72 that meshes with the engagement gear 71 is disposed at the side of the engagement gear 71 so as to be able to move back and forth with respect to the engagement gear 71, and the restraining rack 72 is urged towards, so as to press against, the engagement gear 71 by an urging spring 73.

Particularly in the present embodiment, gear teeth 72*a* of the restraining rack 72 are disposed in a straight manner in the vertical direction. Also, gear teeth 71*a* of the engagement gear 71 and the gear teeth 72*a* of the restraining rack 72 are both involute teeth and configured so that the pressure angle thereof is 8 to 12 degrees. The restraining rack 72 moves, so as to engage with and disengage from the engagement gear 71, along a straight locus in a substantially horizontal direction.

Also, in the present embodiment, the release mechanism 62 is one in which a release knob 80 is disposed, so as to be movable up and down, at a portion of the restraining rack 72 and configured so that the vertical movement of the release knob 80 is converted, via a conversion mechanism, to movement in the horizontal direction along the sheet sending direction of the restraining rack 72.

Figure 8:
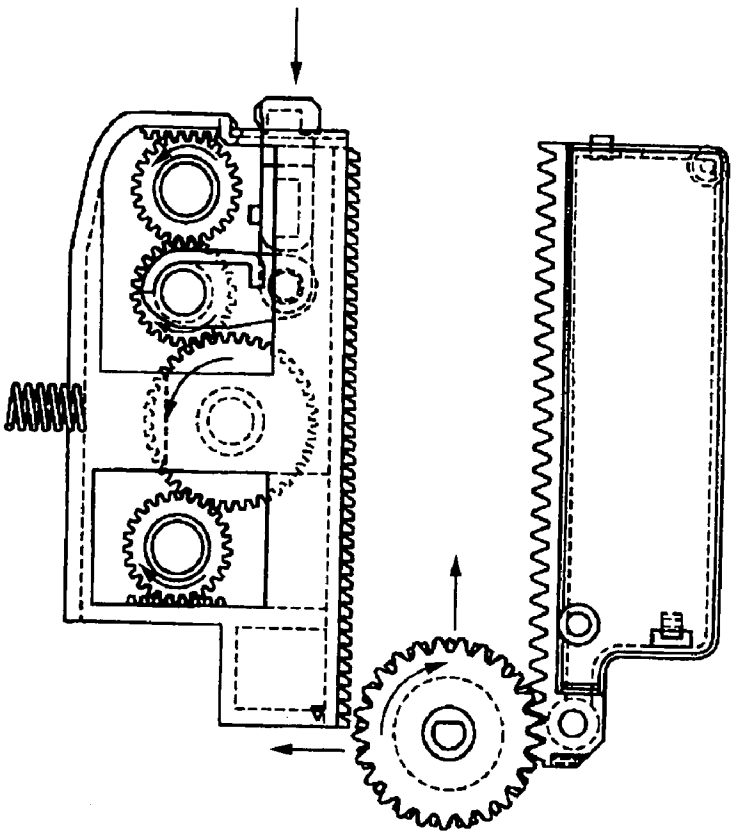
FIG. 8(*a*) is an explanatory view showing a restrained state resulting from the restraining mechanism, and FIG. 8(*b*) is an explanatory view showing a state where the restrained state resulting from the restraining mechanism has been released.
Figure 8:
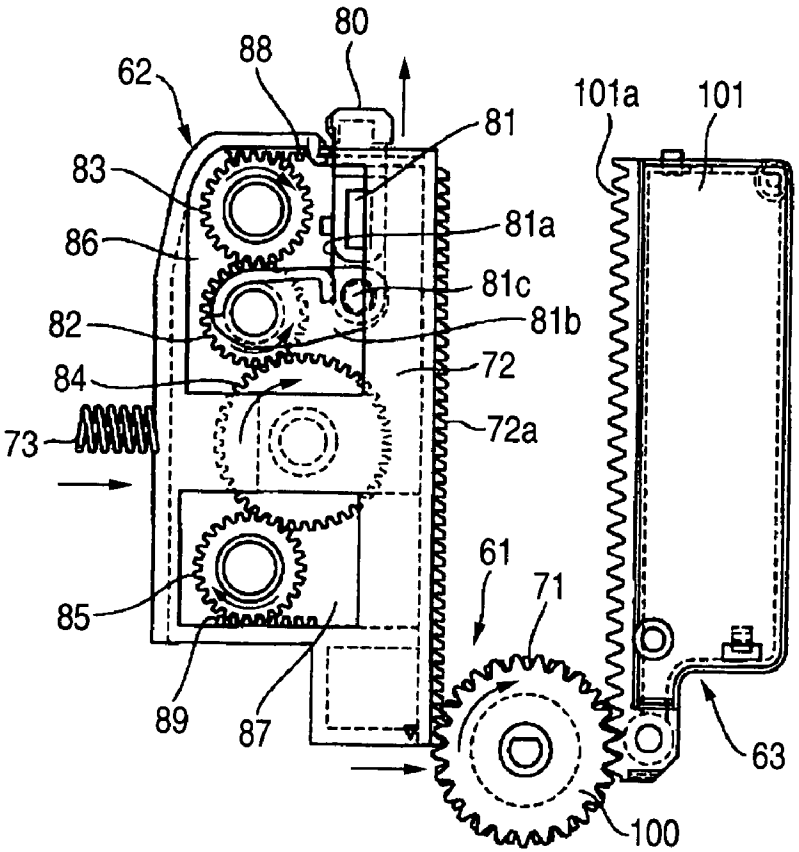

As shown in FIG. 8(*a*), the conversion mechanism includes a link arm 81 in which a pair of link arm portions 81*a* and 81*b* is coupled to a pin 81*c*. The release knob 80 is integrally disposed at a free end portion of the link arm portion 81*a*, and a free end portion of the other link arm portion 81*b* is rotatingly supported by an unillustrated fixing holder. A coupling gear 82 is disposed coaxially with a rotating support shaft of the link arm portion 81*b*. Two transmission gears 83 and 84 are rotatably disposed above and below the coupling gear 82 and one transmission gear 85 is rotatably disposed below the transmission gear 84. Moreover, substantially rectangular cutout openings 86 and 87 are formed in upper and lower portions of the restraining rack 72. Interior racks 88 and 89 that mesh with the transmission gears 83 and 85 are formed at upper and lower edges of the cutout openings 86 and 87.

In the present embodiment, the restraining rack 72 uses the two upper and lower portions at which the transmission gears 83 and 85 and the interior racks 88 and 89 are engaged as driven portions and simultaneously drives both driven portions when the restraining rack 72 moves, whereby the restraining rack 72 moves stably along a straight locus in a substantially horizontal direction at both driven portions.

Also, although the gear ratio of the coupling gear 82 and the transmission gear 83 or 85 may be appropriately selected, by setting the gear ratio of the transmission gears 83 and 85 to be larger than the gear ratio of the coupling gear 82, it becomes possible to amplify and transmit the rotational force of the coupling gear 82 to the driven portions, and the release force by which the release knob 80 is pressed down can be reduced, which is preferable.

In the present embodiment, as shown in FIG. 8(*a*), in a case where the release knob 80 is in a non-release position in a state where it protrudes upward, the restraining rack 72 of the restraining mechanism 61 is pushed against and engages with the engagement gear 71 by the urging force of the urging spring 73 and held in a state where the engagement gear 71 is restrained by the restraining rack 72. It should be noted that the release knob 80 is retained in the non-release position in a state where the restraining rack 72 is retained in the restraining position by the urging force of the urging spring 73.

When the release knob 80 is pressed down as shown in FIG. 8(*b*), the link arm 81 is pressed down in interlocking association with the release knob 80, the coupling gear 82 rotates in the direction of the arrow, the transmission gear 83 or the transmission gears 84 and 85 rotates/rotate in the direction of the arrow in accompaniment with the rotation of the coupling gear 82, and the restraining rack 72 is moved in the direction away from the engagement gear 71 due to the engaged movement between the transmission gears 83 and 85 and the interior racks 88 and 89.

Figure 9:
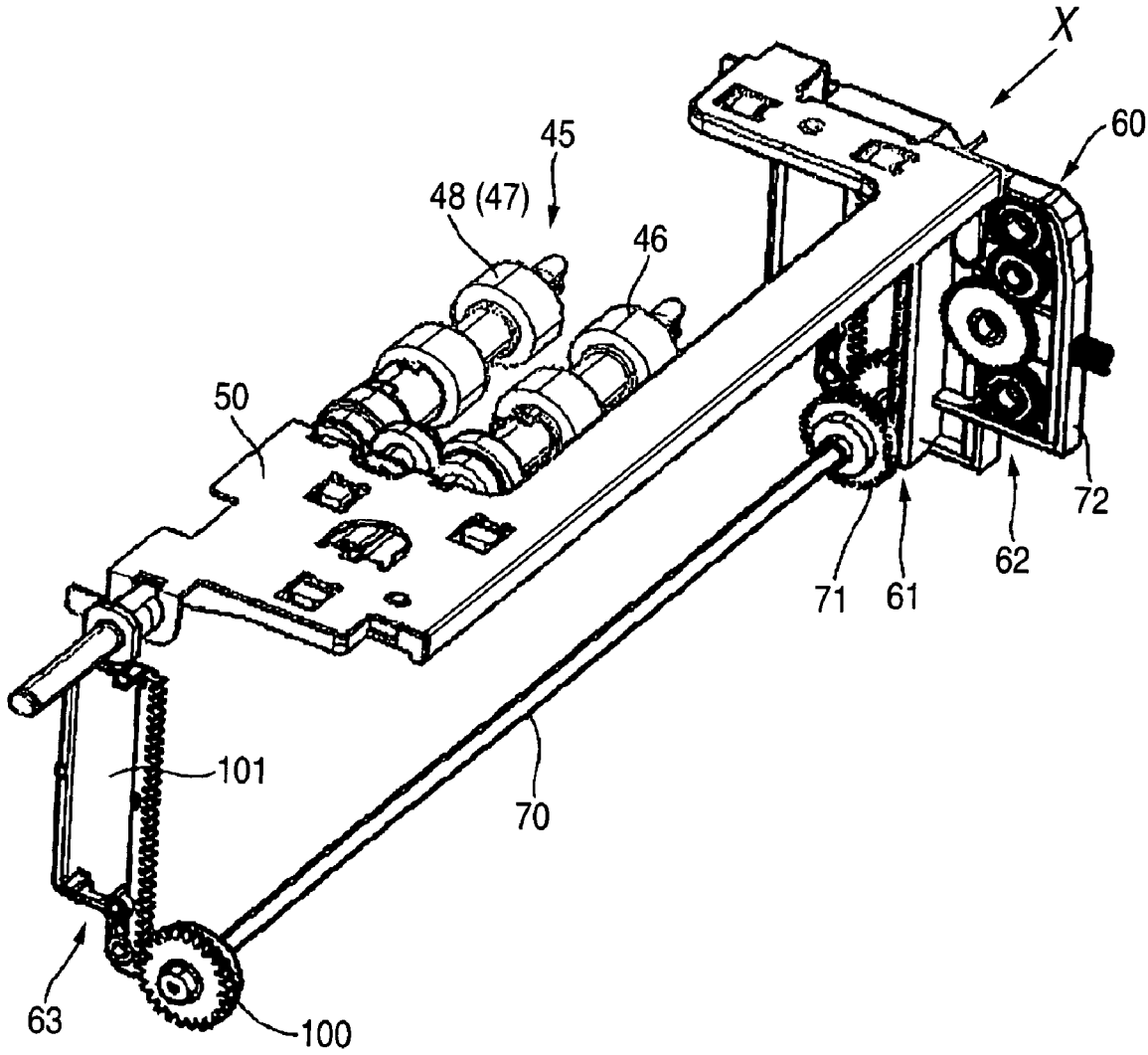
FIG. 9 is a perspective view showing an overall configuration including release operation members of the release mechanism used in the first embodiment.
Figure 10:
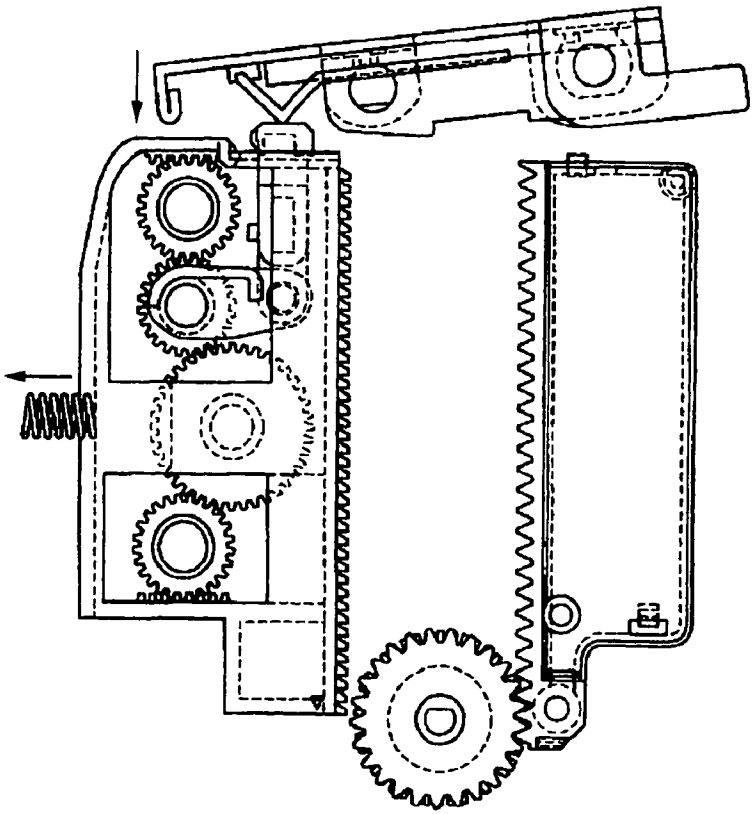
FIG. 10(*a*) is an explanatory view seen from direction X in FIG. 9 and shows a state where the release mechanism is not working, and FIG. 10(*b*) is an explanatory view showing a state where the release mechanism has worked.
Figure 10:
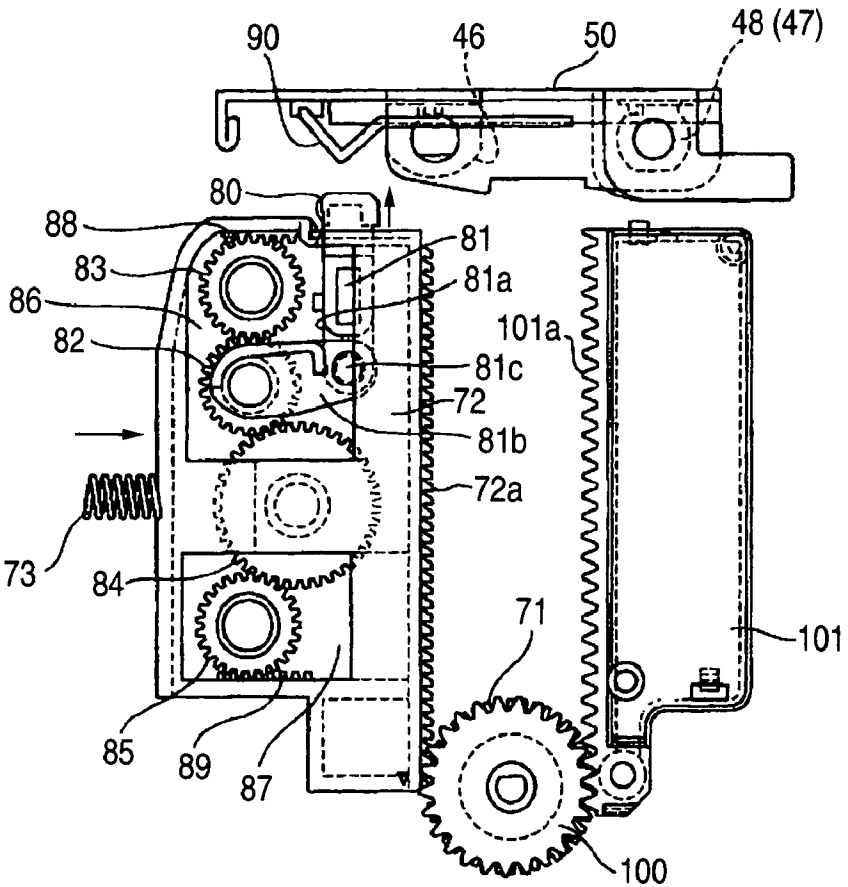

Also, in the present embodiment, as the operational mechanism by which the release knob 80 is pressed down, a mechanism is used in which, as shown for example in FIGS. 9 and 10, an operational protrusion 90 protrudes downward from part of the swinging plate 50 of the sheet feeding unit 45, and the release knob 80 is pushed down by the operational protrusion 90 fixed to the swinging plate 50 that swings following the pickup roll 46 of the sheet feeding unit 45.

Moreover, as shown in FIGS. 4 to 8(*b*), the guide mechanism 63 in the present embodiment includes guide gears 100 disposed at both ends of the rotating shaft 70 and guide racks 101 that engage with the guide gears 100 to guide the locus of movement of the bottom plate 42. One pair of the guide gears 100 and the guide racks 101 are disposed at both sides of the sheet tray 41.

In the present embodiment, gear teeth 101*a* of the guide racks 101 are straightly disposed in the vertical direction. Also, the gear teeth 100*a* of the guide gears 100 and the guide teeth 101*a* of the guide racks 101 are both involute teeth and configured so that the pressure angle thereof is 8 to 12 degrees.

Also, although the gear module of the guide mechanism 63 and the restraining mechanism 61 may be appropriately selected, the gear module of the restraining mechanism 61 in the present embodiment is set to be lower than the gear module of the guide mechanism 63 so that the precision of sheet position control can be improved and tooth skipping of the gears resulting from the guide mechanism 63 can be effectively prevented.

Figure 5:
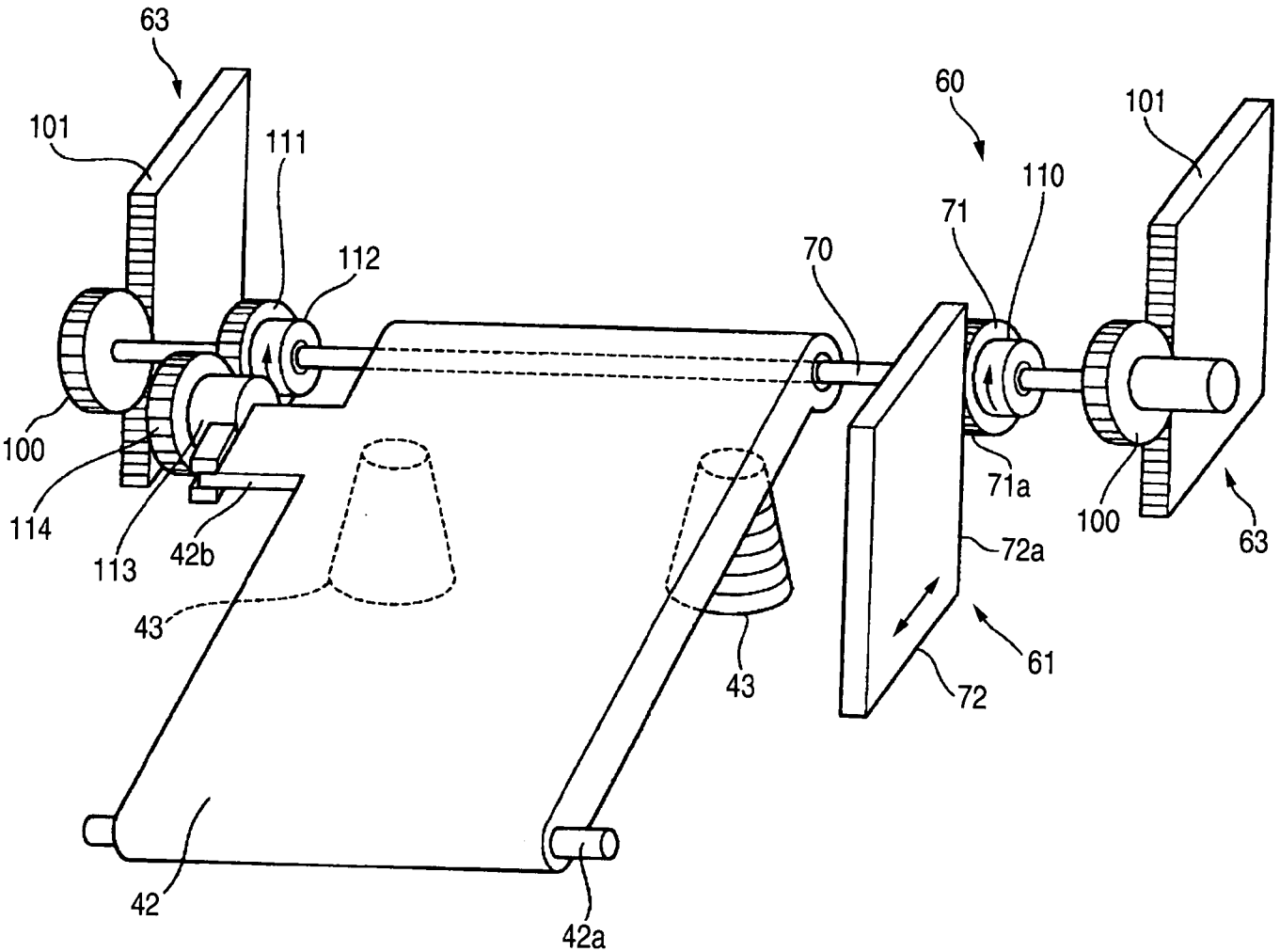
FIG. 5 is a perspective view showing the main parts of the sheet feeding device according to the first embodiment.
Figure 6:
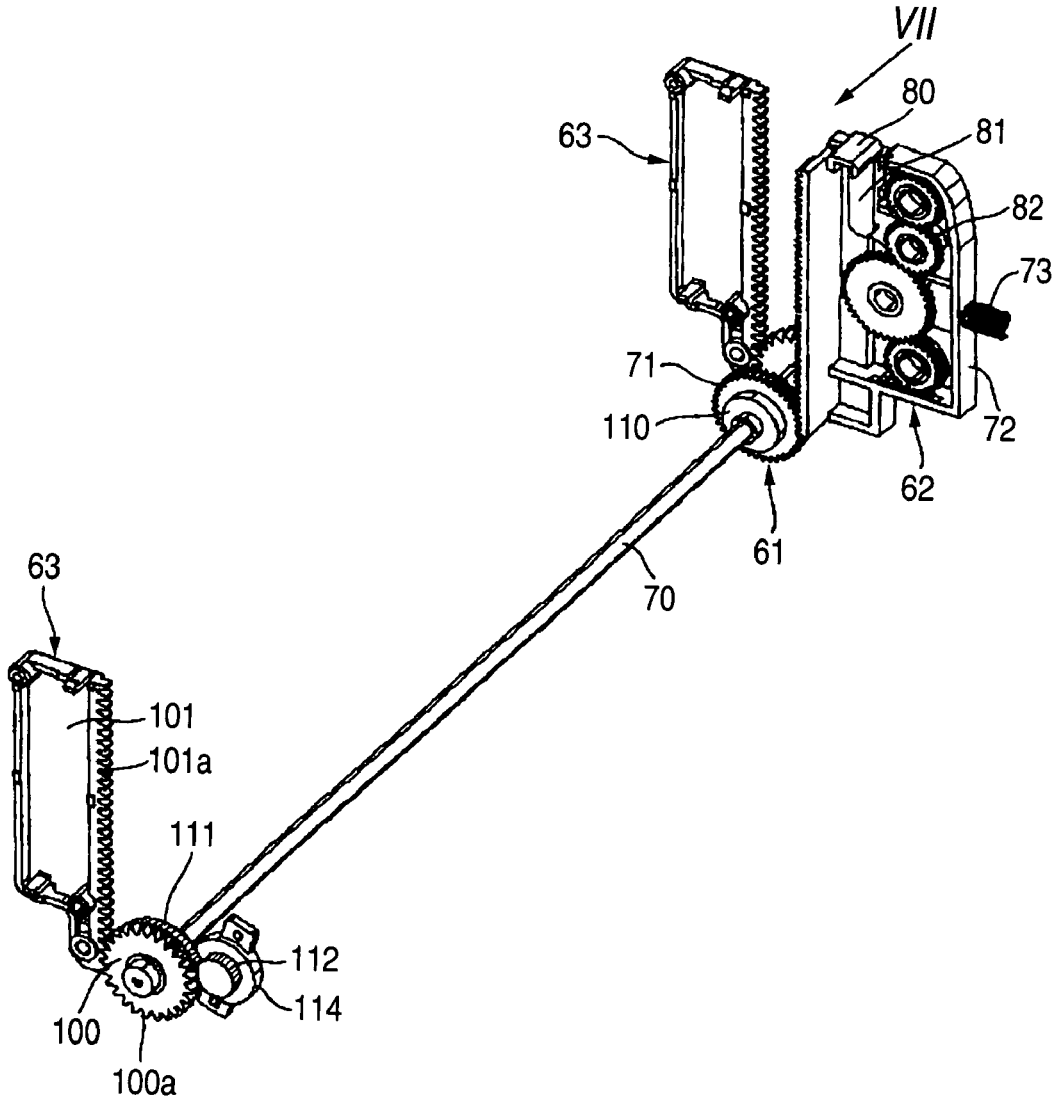
FIG. 6 is a perspective view showing the overall configuration of a restraining mechanism and the main parts of a release mechanism used in the first embodiment.
Figure 7:
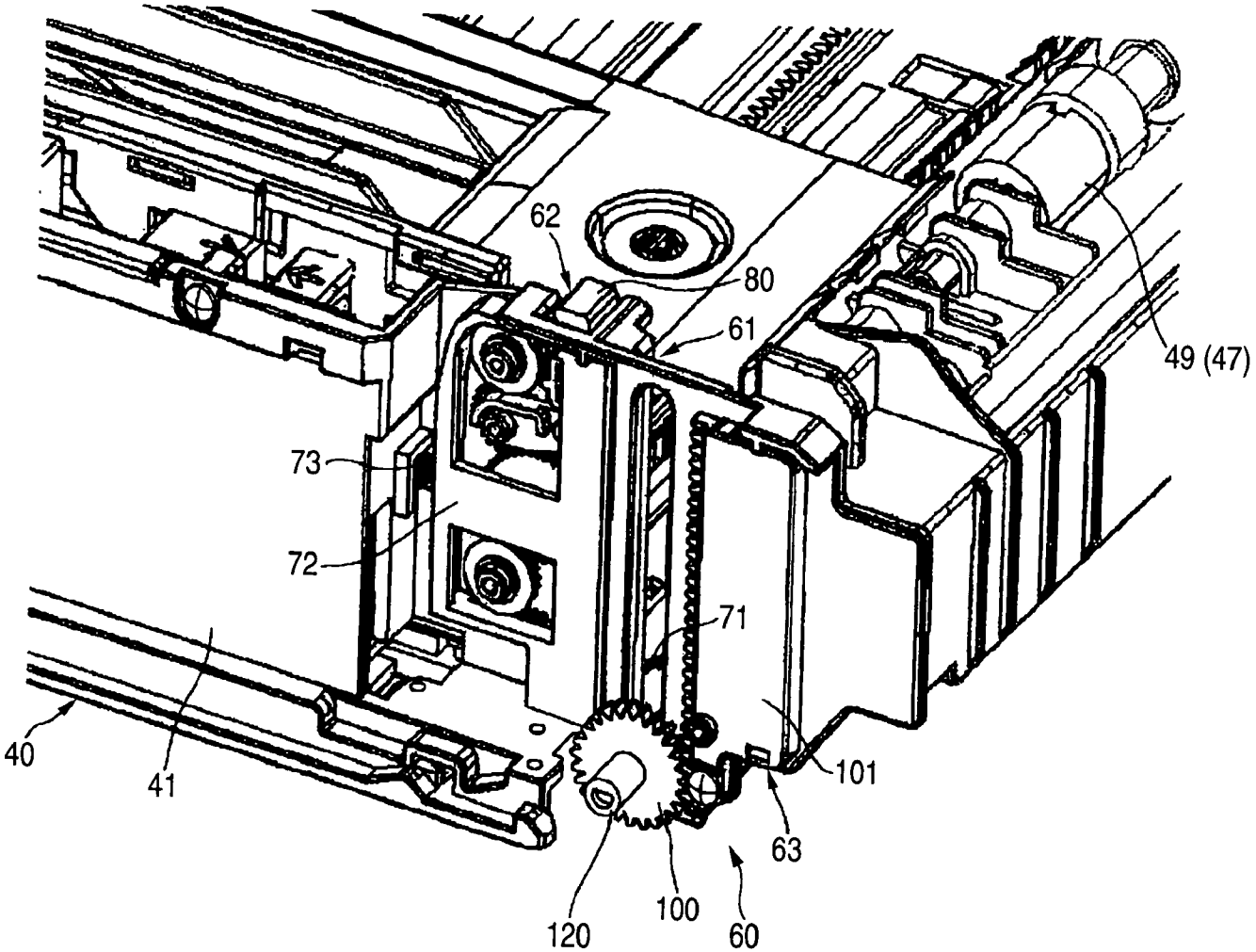
FIG. 7 is a view of main parts seen from direction VIA in FIG. 6.

Moreover, particularly as shown in FIGS. 5 and 6, the engagement gear 71 of the restraining mechanism 61 in the present embodiment is fixed to the rotating shaft 70 via a one-way clutch 110.

In the present embodiment, an oil damper 114 that imparts a buffering force to the movement of the bottom plate 42 is disposed. The oil damper 114 is attached to an attachment piece 42*b* formed so as to protrude from the bottom plate 42 and includes a damper gear 113 for drive transmission. A support gear 111 that engages with the damper gear 113 is fixed via a one-way clutch 112 to the side of the rotating shaft 70 opposite from the place where the engagement gear 71 is disposed.

Here, when the rotating shaft 70 moves upward, the one-way clutches 110 and 112 transmit that first direction rotation to the engagement gear 71 and the support gear 111. When the rotating shaft 70 moves downward, the one-way clutches 110 and 112 do not transmit that second direction rotation to the gears 71 and 111.

Also, when the rotating shaft 70 moves upward and rotates in the first direction, the support gear 111 rotates and the oil damper 114 imparts a load (buffering force) to the rotation and movement of the rotating shaft 70 in accompaniment therewith. When the rotating shaft 70 moves downward and rotates in the second direction, the oil damper 114 does not impart a load (buffering force) to the rotation and movement of the rotating shaft 70 because the support gear 111 does not rotate.

Figure 11:
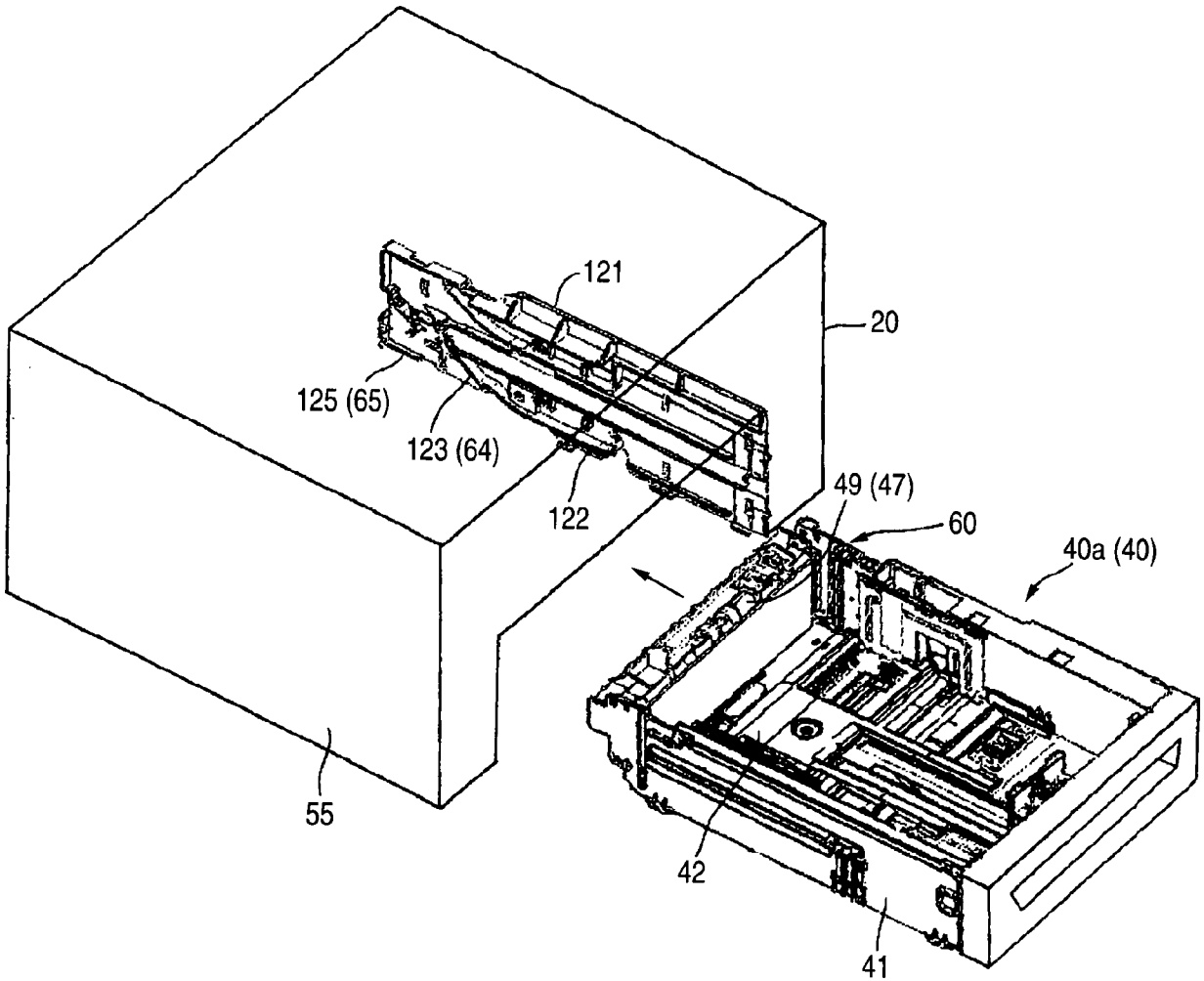
FIG. 11 is an explanatory view showing an overall return mechanism used in the first embodiment.

In the present embodiment, as shown in FIG. 11, a return mechanism 64 that returns the bottom plate 42 to a return position that is a lift-up initial position of the bottom plate 42 is disposed.

Here, a return position P0 (see FIG. 13) refers to a lower position most removed from a lift-up position (the position of the bottom plate 42 when sheet sending preparation has been completed; specifically corresponds to a state where the bottom plate 42 is lifted up so as to contact the pickup roll 46 of the sheet feeding unit 45 when the sheet tray 41 is attached to the tray receiving portion 55 of the apparatus body 20) of the bottom plate 42.

Figure 12:
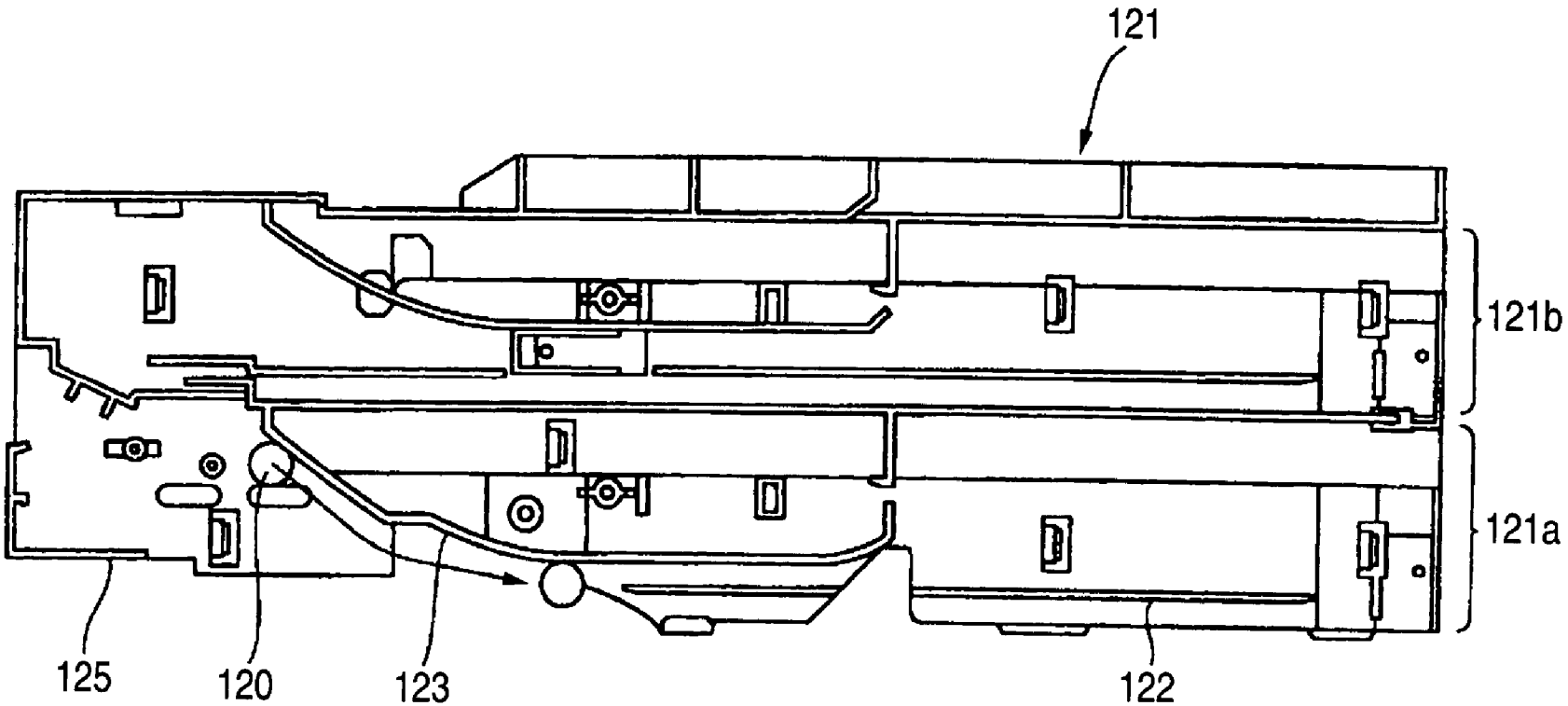
FIG. 12 is an explanatory view showing the movement process of the return mechanism used in the first embodiment.
Figure 13:
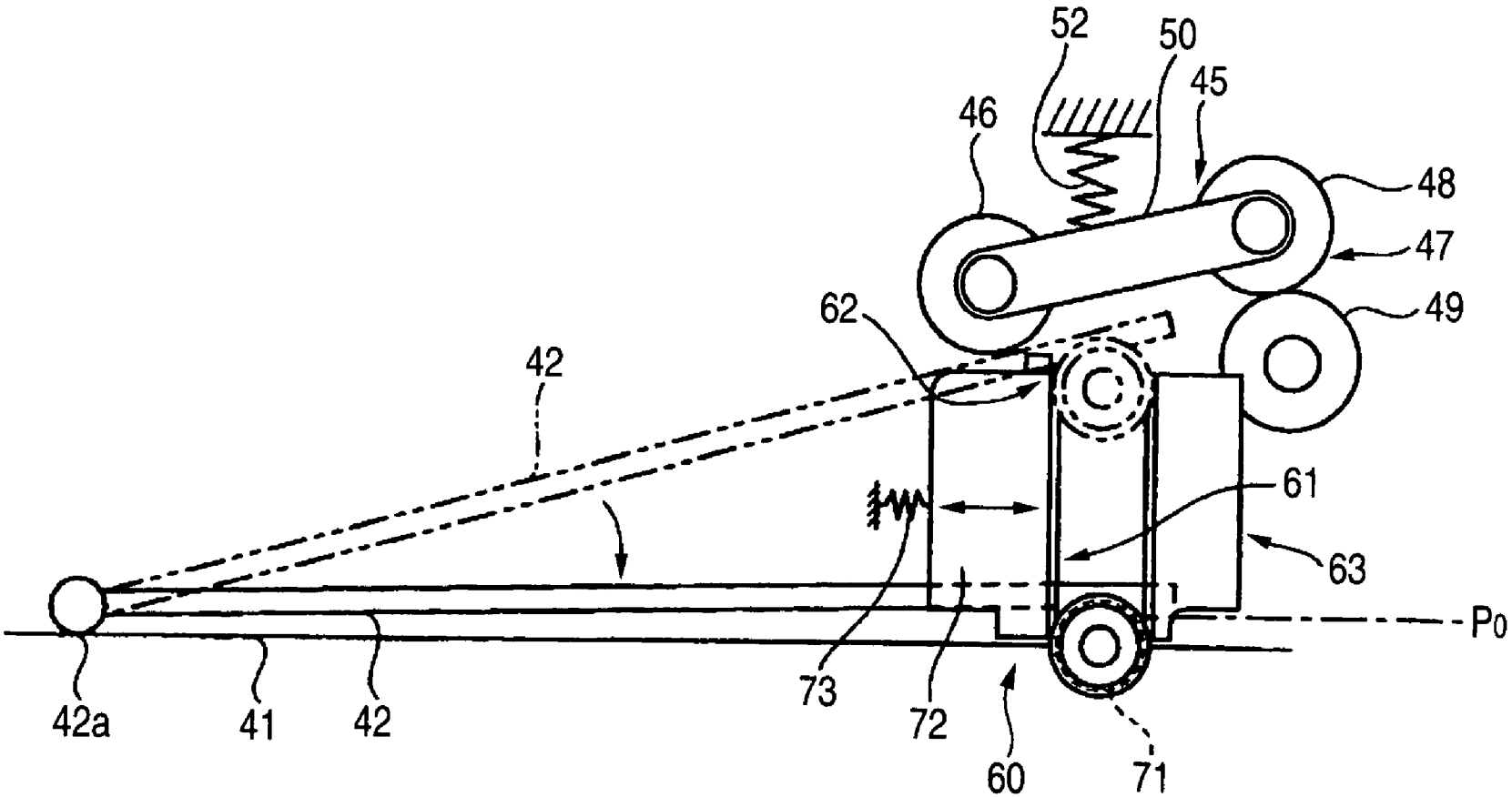
FIG. 13 is an explanatory view showing a moving state when the return mechanism has worked in the first embodiment.
Figure 14:
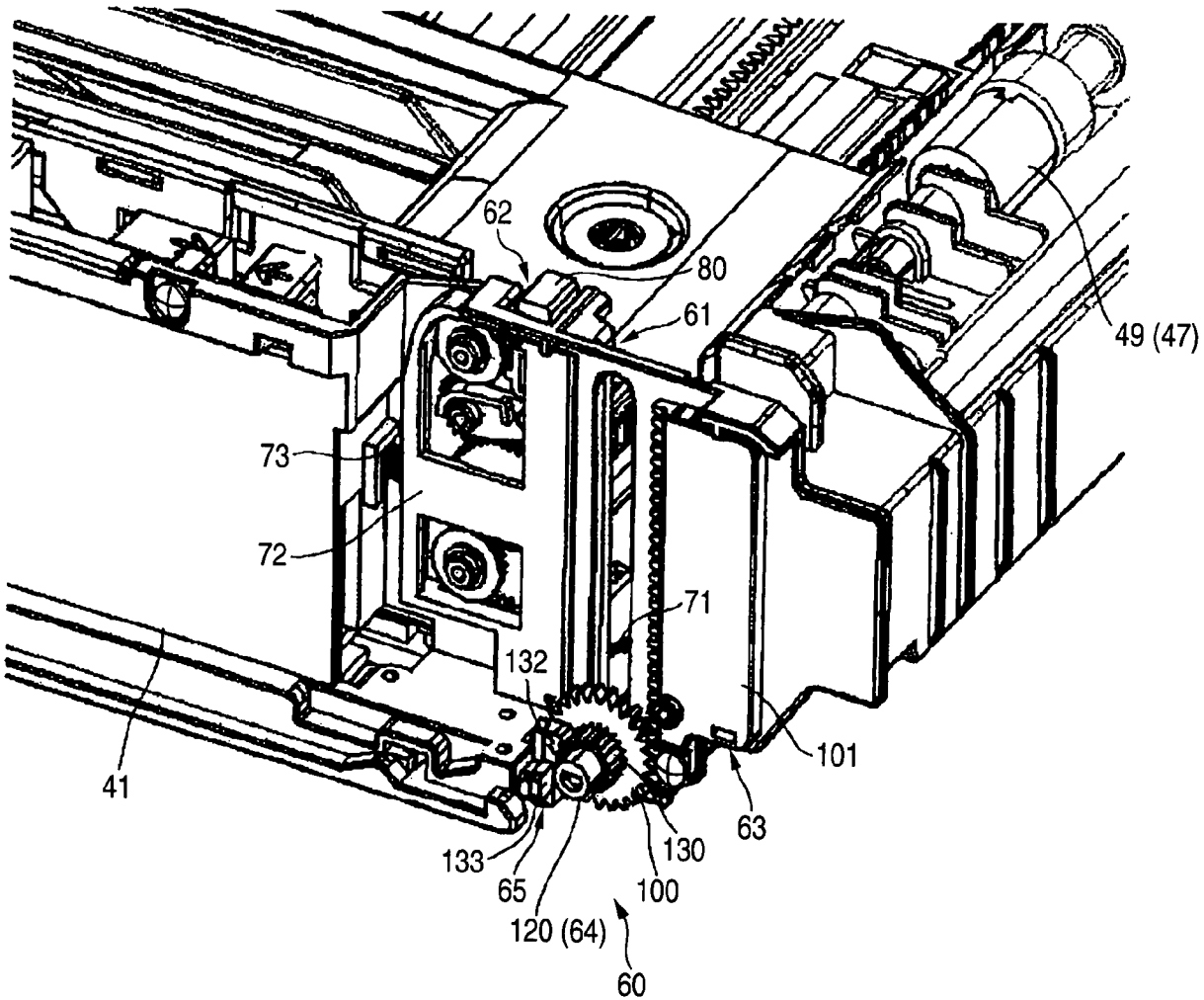
FIG. 14 is an explanatory view showing a mode where a lock mechanism has been added to the return mechanism in the first embodiment.

As shown in FIGS. 11 to 13, in the return mechanism 64 in the present embodiment, a return-use engagement pin 120 (see FIG. 7) is disposed at one end of the rotating shaft 70 of the bottom plate 42, and a push-down mechanism by which the return-use engagement pin 120 is forcibly pushed down is disposed at both sides of the tray receiving portion 55 of the apparatus body 20.

Here, a tray holder 121 is disposed at at least both sides of the tray receiving portion 55. The tray holders 121 include functional portions 121*a* and 121*b* corresponding to the upper and lower two-tier sheet feeding devices 40*a* and 40*b*, with each functional portion being disposed with a guide rail 122 and a push-down mechanism by which the sheet tray 41 is slidably supported so that it can be pulled out.

In the present embodiment, the push-down mechanism is one in which a guide cam 123, with which the locus of movement of the return-use engagement pin 120 is regulated, is disposed in part of the tray holder 121. When the sheet tray 41 is pulled out from the loaded position, the return-use engagement pin 120 is brought into contact with the cam surface of the guide cam 123, and the return-use engagement pin 120 is forcibly moved along the cam surface from the position corresponding to the lift-up position to the return position. In the present example, at the position where the sheet tray 41 has been completely pulled out, the return-use engagement pin 120 is lowered to the lowermost end position of the guide cam 123 to regulate the bottom plate 42 to the return position.

Now, the operation of the sheet processing apparatus according to the present embodiment will be described with emphasis given to the sheet feeding device.

For example, in FIGS. 4 and 8(*a*) and 8(*b*), when the sheets S are successively fed by the sheet feeding unit 45, the sheets S stacked on the bottom plate 42 are gradually reduced.

In so doing, because the sheet feeding unit 45 is pushed downward by the urging force of the urging spring 52, the position of the pickup roll 46 is lowered from a predetermined position in accompaniment with the reduction of the sheets S.

In this state, the swinging plate 50 of the sheet feeding unit 45 is lowered from a predetermined position and, in accompaniment therewith, the release knob 80 is lowered from the non-release position (see FIG. 10(*a*)) to the release position (see FIG. 10(*b*)) by the operational protrusion 90 of the swinging plate 50, and the restraining rack 72 moves in the direction away from the engagement gear 71.

In so doing, the rotational restraint on the engagement gear 71 resulting from the restraining rack 72 is released and the engagement gear 72 is free to rotate. In this state, the bottom plate 42 is lifted upward by the urging force of the elastic spring 43.

At this time, the pickup roll 46 is pushed upward via the sheets S stacked on the bottom plate 42. Because the swinging plate 50 is also pushed upward in accompaniment therewith, the release knob 80 contacting the operational protrusion 90 of the swinging plate 50 also rises upward due to the urging force of the urging spring 73.

Subsequently, as shown in FIGS. 10(*a*) and 10(*b*), the restraint release state of the restraining mechanism 61 resulting from the release mechanism 62 is released, and the restraining rack 72 moves towards and engages with the engagement gear 71 and restrains the rotation of the engagement gear 71.

At this time, in the present embodiment, the restraining rack 72 moves so as to engage with and disengage from the engagement gear 71 along the straight locus in a substantially horizontal direction. Thus, for example, in comparison to a comparative mode where the restraining rack 72 moves along a revolving locus, there is little abrasion in a state where the teeth surfaces of the gears are pressed. Thus, the engagement and disengagement operations between the restraining rack 72 and the engagement gear 71 are conducted smoothly and stably.

At this stage, the position of the bottom plate 42 becomes restrained, the position of the uppermost sheet S1 of the sheets S stacked on the bottom plate 42 is continually held at a substantial constant, the nipping pressure of the pickup roll 46 with respect to the uppermost sheet S1 becomes substantially constant, and the sending position of the uppermost sheet S1 by the pickup roll 46 becomes substantially constant. Thus, the conditions (insertion force and insertion angle) in which the uppermost sheet S1 is inserted into the separating mechanism 47 become substantially constant. Accordingly, the sending operation of the sheets S by the pickup roll 46 is conducted stably and the separating operation by the separating mechanism 47 is conducted stably.

Additionally, after the sheets S sent from the pickup roll 46 are separated one sheet at a time by the separating mechanism 47, they are conveyed to the sheet conveyance path 28 shown in FIG. 2.

Thereafter, the same operation is repeated each time the sheets S are reduced by a predetermined amount, the rotational restraint on the engagement gear 71 resulting from the restraining rack 72 is released in accompaniment with the reduction of sheets S, and the bottom plate 42 rises. Thereafter, the rotational restraint on the engagement gear 71 by the restraining rack 72 is again conducted, and the position of the bottom plate 42 is restrained so that the position of the uppermost sheet S1 of the sheets S stacked on the bottom plate 42 becomes a substantially constant position.

Moreover, as shown in FIG. 2, the sheets S sent from the sheet feeding device are conveyed upwards through the sheet conveyance path 28 and positioned by the registration roll 29. Thereafter, a visible image (toner image) on the photosensitive drum 22*a* is transferred to the sheets S at the transfer nipping region between the photosensitive drum 22*a* and the transfer device 24, the image is fixed at the fixing device 25, and the sheets S are discharged onto the discharge tray 27 through the discharge roll 30.

Because the feeding operation of the sheets S by the sheet feeding device 40—and in particular the sending operation of the sheets S by the pickup roll 46—is extremely stable in this imaging process, imaging errors dependent on poor feeding of the sheets S in the sheet feeding device 40 can be significantly reduced.

As shown in FIGS. 11 to 13, when the sheet tray 41 has run out of sheets, the pickup roll 46 of the sheet feeding unit 45 is brought into direct contact with the bottom plate 42.

In this case, when the user is informed of the fact that there are no sheets in the sheet tray 41 by an unillustrated sheet sensor, the user conducts a sheet setting operation after pulling out the sheet tray 41.

At this time, when the sheet tray 41 is pulled out from the apparatus body 20, the bottom plate 42 is returned to the return position P0 by the action of the return mechanism 64 (the return-use engagement pin 120 and the guide cam 123) during the time that the sheet tray 41 is pulled out. For this reason, the bottom plate 42 is not lifted up when sheets are being placed in the sheet tray 41, whereby the sheet setting operation is conducted smoothly.

Moreover, during the process by which the sheet-set sheet tray 41 is loaded into the tray receiving portion 55 of the apparatus body 20, the bottom plate 42 is not set in the lift-up position until the sheet tray 41 is completely loaded by the action of the return mechanism 64. Thus, during the process by which the sheet tray 41 is loaded, no drawbacks arise, such as the uppermost sheet of the sheet stack getting caught at the middle of the tray receiving portion 55.

In the present embodiment, when the sheet tray 41 is completely removed from the apparatus body 20, the restraining mechanism 61 works in the state where the bottom plate 42 has been returned to the return position P0, whereby it is possible to retain the bottom plate 42 of the removed sheet tray 41 at the return position P0.

However, when the release knob 80 of the release mechanism 62 is inadvertently pushed down during the sheet setting operation, the restrained state of the bottom plate 42 resulting from the restraining mechanism 61 ends up being released, whereby the bottom plate 42 ends up rising from the return position P0 to the lift-up position. In this case, there is the potential for the lifted-up bottom plate 42 to interfere with the sheet setting operation.

In the present embodiment, in order to eliminate this type of drawback, it is preferable to add, as shown for example in FIGS. 14 to 18, a lock mechanism 65 to the return mechanism 64 in addition to the interlocking mechanism 60 including the restraining mechanism 61, the release mechanism 62 and the guide mechanism 63, and the return mechanism 64.

The lock mechanism 65 is one in which a lock engagement gear 130 serving as a locked member is disposed at one end of the rotating shaft 70 of the bottom plate 42 and a lock restraint release member 131 that engages with and disengages from this lock engagement gear 130 is disposed.

In the present embodiment, the lock engagement gear 130 includes sawtooth-like gear teeth 130*a*. The lock restraint release member 131 integrally includes a lock restraint rack 132, on which sawtooth gear teeth 132*a* are formed, at the lock engagement gear 130 side of a lock member body 134.

Here, the respective gear teeth 130*a* and 132*a* of the lock engagement gear 130 and the lock restraint rack 132 engage as saw teeth of an orientation in which it is difficult for the rotating shaft 70 of the bottom plate 42 to move upwards.

Figure 16:
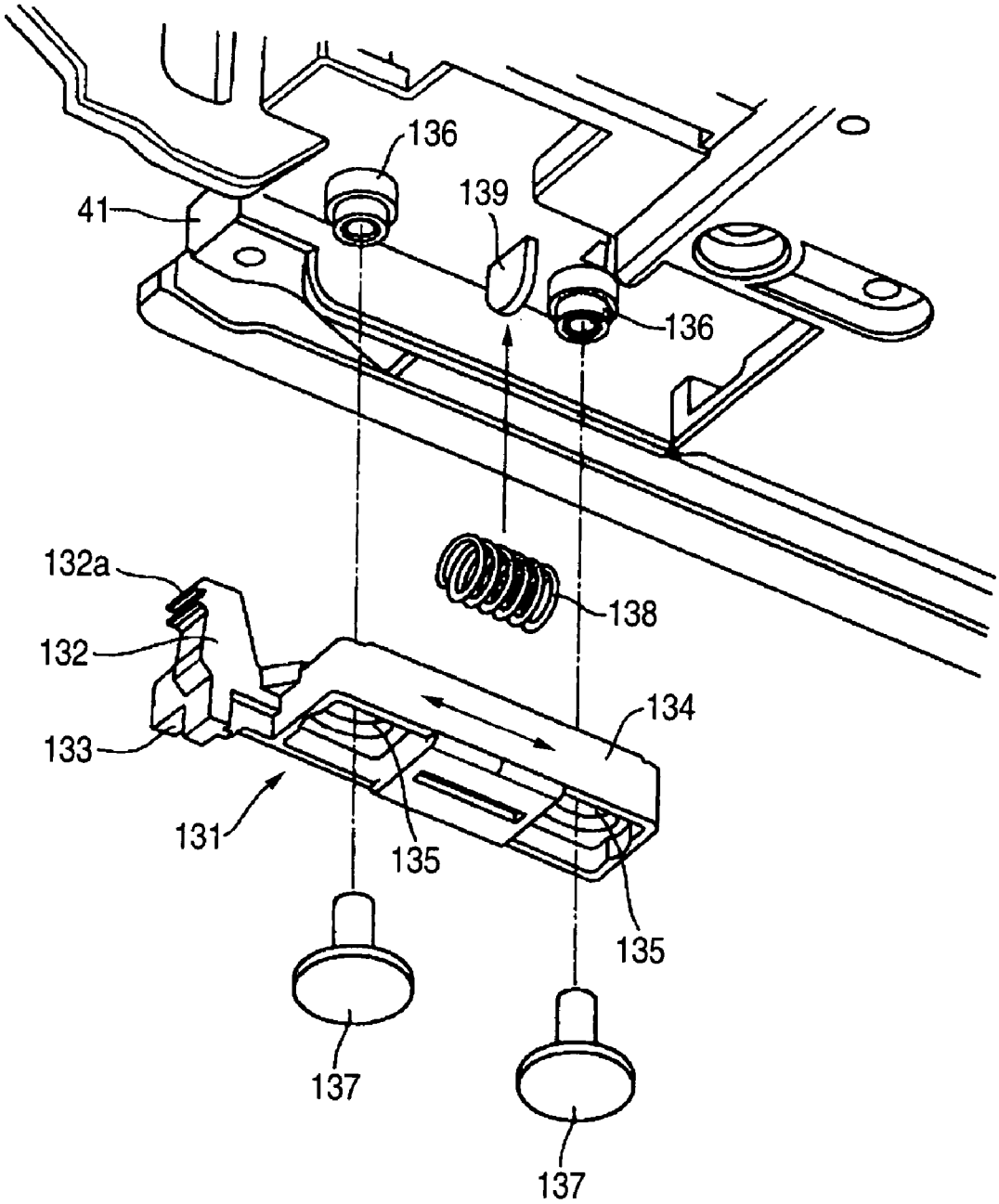
FIG. 16 is an exploded perspective view showing the configuration of the lock mechanism in the first embodiment.

Additionally, the lock restraint release member 131, particularly as shown in FIG. 16, is disposed with plural long holes 135 in the lock member body 134. Bosses 136 that slidably engage with the long holes 135 are disposed so as to protrude from the bottom portion of the sheet tray 41, and screw holes are formed inside the bosses 136. Attachment screws 137 are inserted into the screw holes of the bosses 136 via the long holes 135. Moreover, an urging spring 138, one end of which is locked at a locking piece 139 of the sheet tray 41, is incorporated inside the lock member body 134. The urging spring 138 pushes and urges the lock restraint release member 131 towards the lock engagement gear 130.

In the present embodiment, the lock restraint release member 131 is disposed at a position where it engages with the lock engagement gear 130 when the bottom plate 42 has reached the return position.

Also, a release-use protruding piece 133 is formed so as to protrude from part of the lock restraint rack 132 of the lock restraint release member 131. As shown, for example, in FIGS. 11 and 12, the release-use protruding piece 133 contacts a stopper 125 formed at part of the tray holder 121 in a state where the sheet tray 41 has been completely loaded into the tray receiving portion 55. The lock restraint release member 131 retreats from the lock engagement gear 130 counter to the urging force of the urging spring 138, whereby the meshed state between the lock engagement gear 130 and the lock restraint rack 132 is released.

Figure 17:
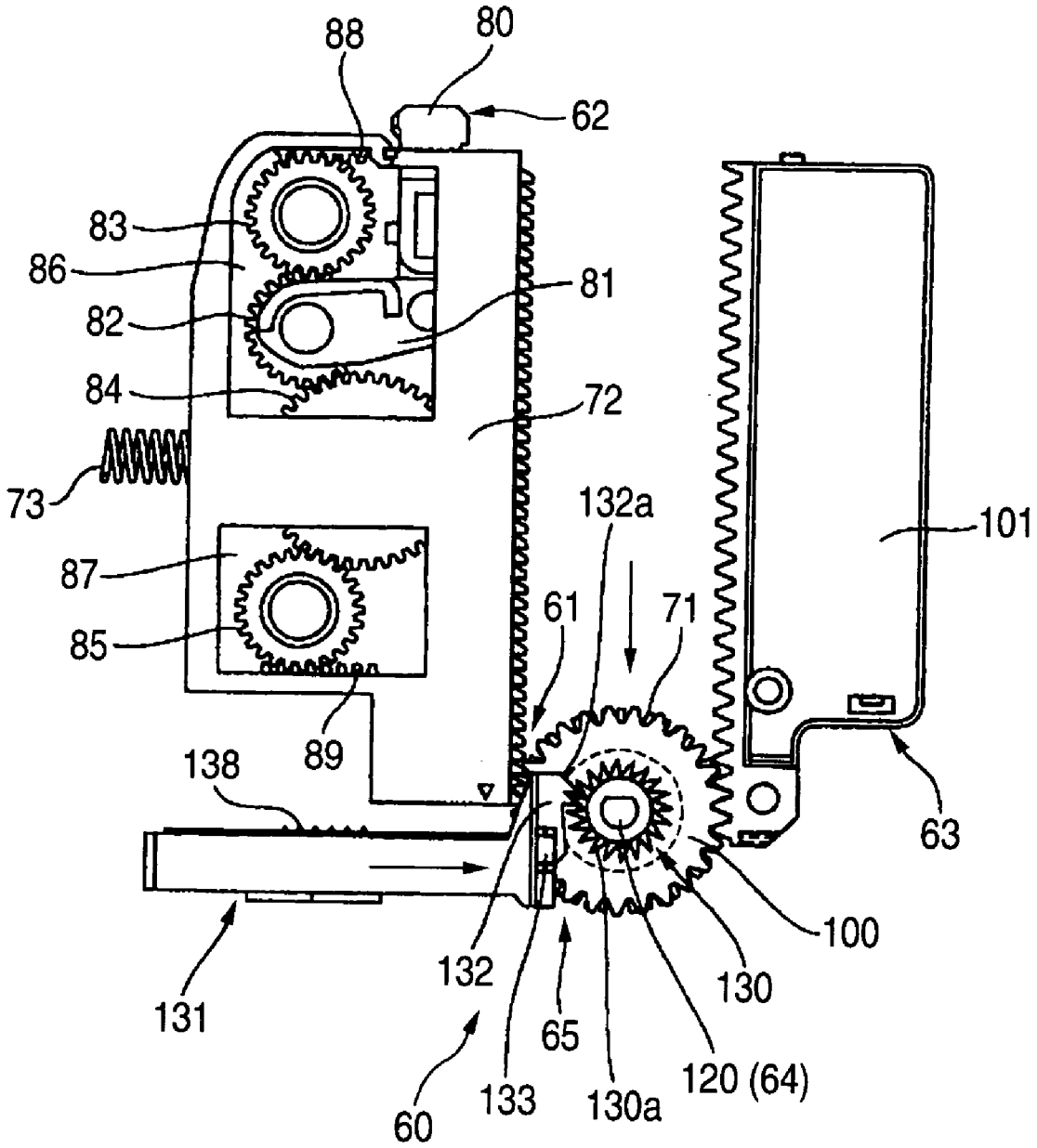
FIG. 17 is an explanatory diagram showing a locked state of the return mechanism resulting from the lock mechanism.
Figure 18:
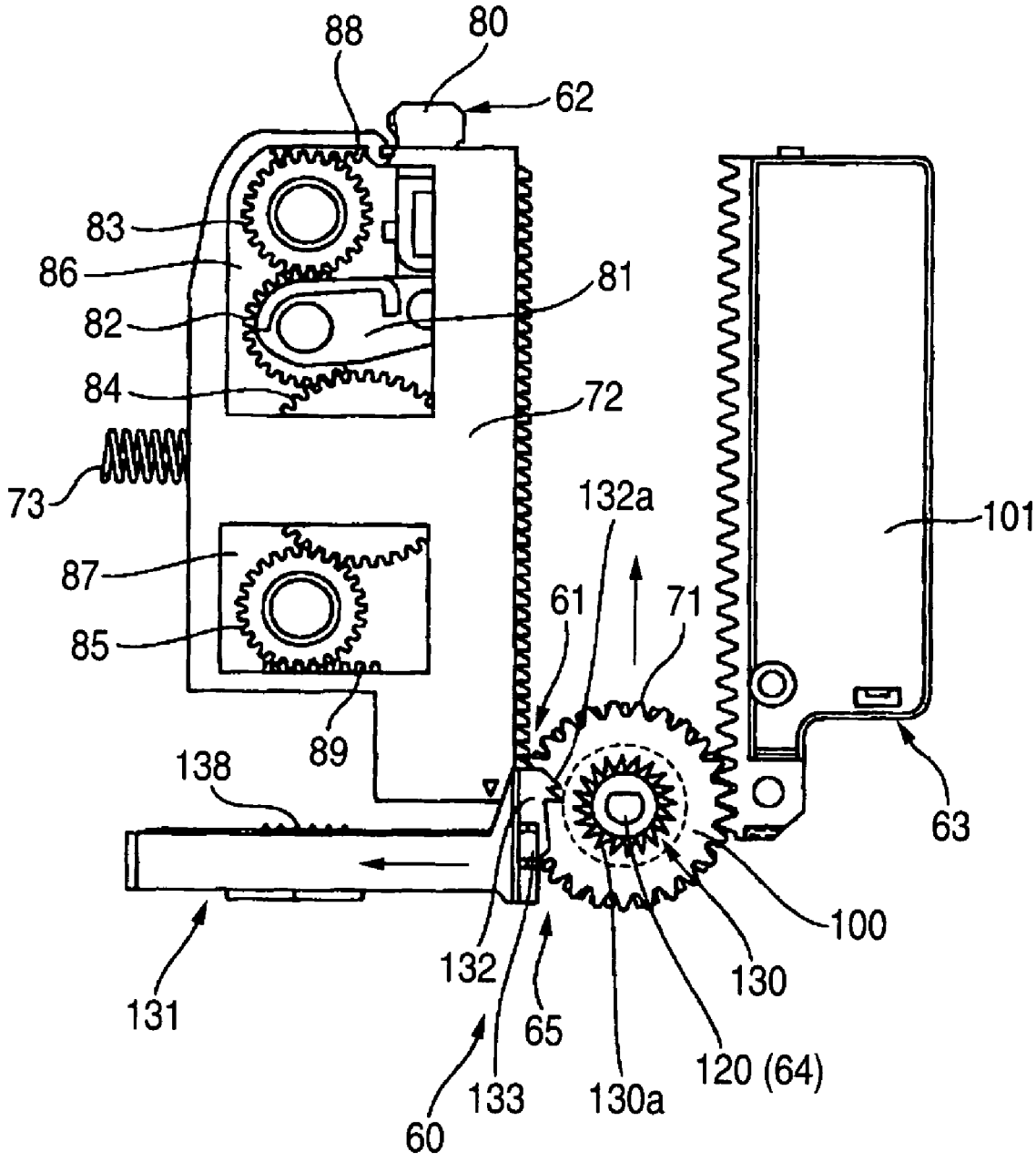
FIG. 18 is an explanatory view showing a lock release state of the return mechanism resulting from the lock mechanism.

For this reason, as shown in FIG. 17, when the bottom plate 42 reaches the return position, the lock restraint rack 132 of the lock restraint release member 131 meshes with the lock engagement gear 130 and the lock restraint release member 131 restrains the rotation of the lock engagement gear 130. In this state, the lock mechanism 65 is set to a locked state.

At this time, because the lock restraint release member 131 is pushed and urged against the lock engagement gear 130 along a straight locus in a substantially horizontal direction, it is easy for the gear teeth 132*a* of the lock restraint rack 132 to cross over the gear teeth 130*a* of the lock engagement gear 130, so that the meshing operation of both is conducted smoothly.

In a case where the user inadvertently pushes down the release knob 80 of the release mechanism 62 in this state, the restrained state resulting from the restraining mechanism 61 is released. However, because the locked state resulting from the lock mechanism 65 with respect to the return mechanism 64 is maintained, the bottom plate 42 does not rise to the lift-up position and there is no potential for the ability with which sheets are set in the sheet tray 41 to be compromised.

When the sheet tray 41 is inserted into the tray receiving portion 55 of the apparatus body 20 after the sheets have been set in the sheet tray 41, the sheet tray 41 is inserted and loaded into the tray receiving portion 55 with the return mechanism 64 remaining in an unchanged state.

Figure 15:
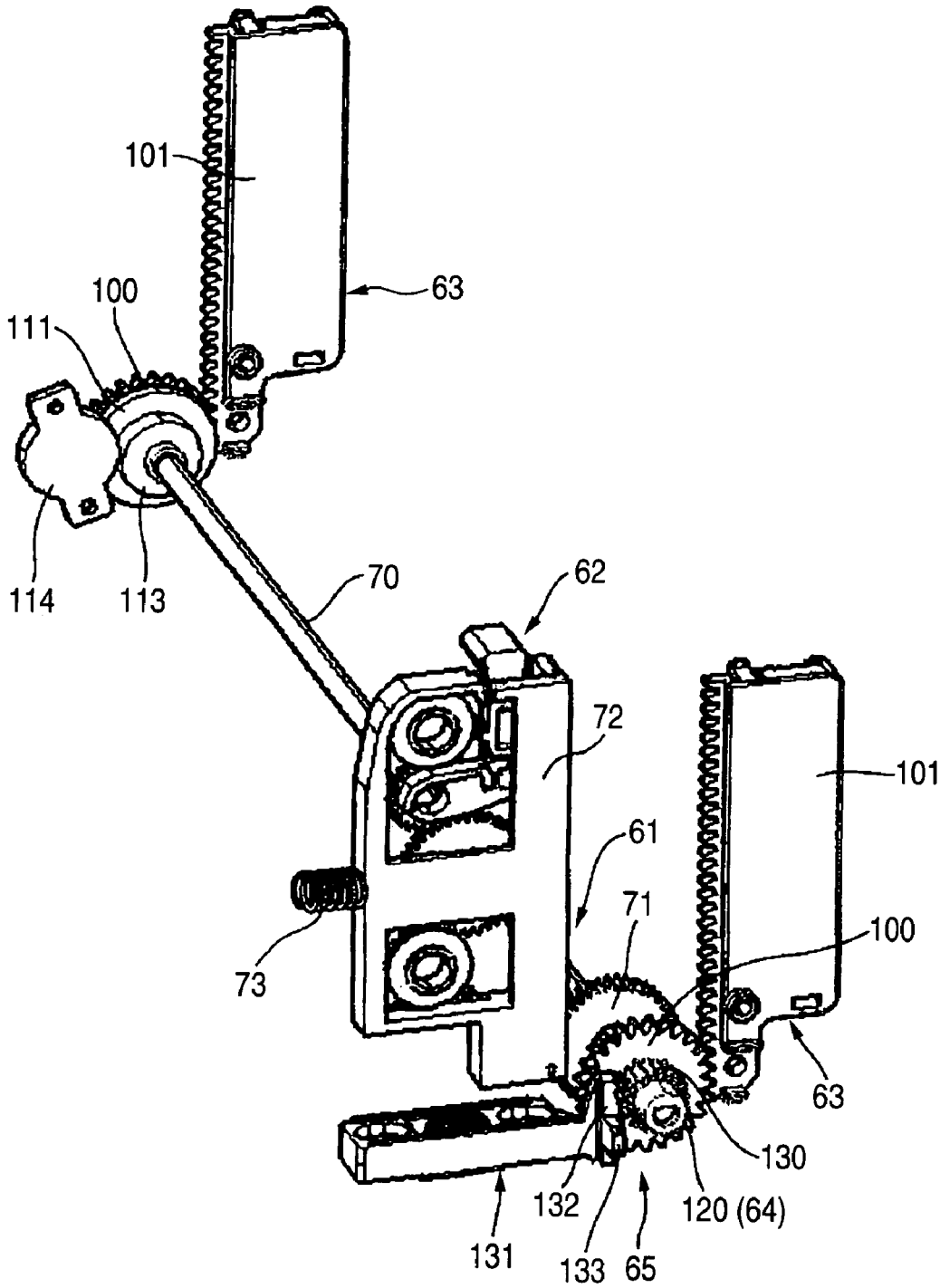
FIG. 15 is an explanatory view showing the interrelation between the restraining mechanism, the release mechanism and the lock mechanism in the first embodiment.

At this time, in a state where the sheet tray 41 has been completely loaded into the tray receiving portion 55, as shown in FIGS. 11, 12 and 15, the release-use protruding piece 133 of the lock restraint release member 131 of the lock mechanism 65 is brought into contact with the stopper 125 of the tray holder 121 and the lock restraint release member 131 retreats, whereby the restrained state of the lock engagement gear 130 resulting from the lock restraint rack 132 of the lock restraint release member 131 is released.

In this state, the locked state of the bottom plate 42 that had been locked in the return position by the lock mechanism 65 is released, whereby the bottom plate 42 is lifted up to the lift-up position, the stack of sheets stacked on the bottom plate 42 is disposed so as to contact the pick-up roll 46 of the sheet feeding unit 45 and the sheet sending preparations are concluded.

Second Embodiment

Figure 19:
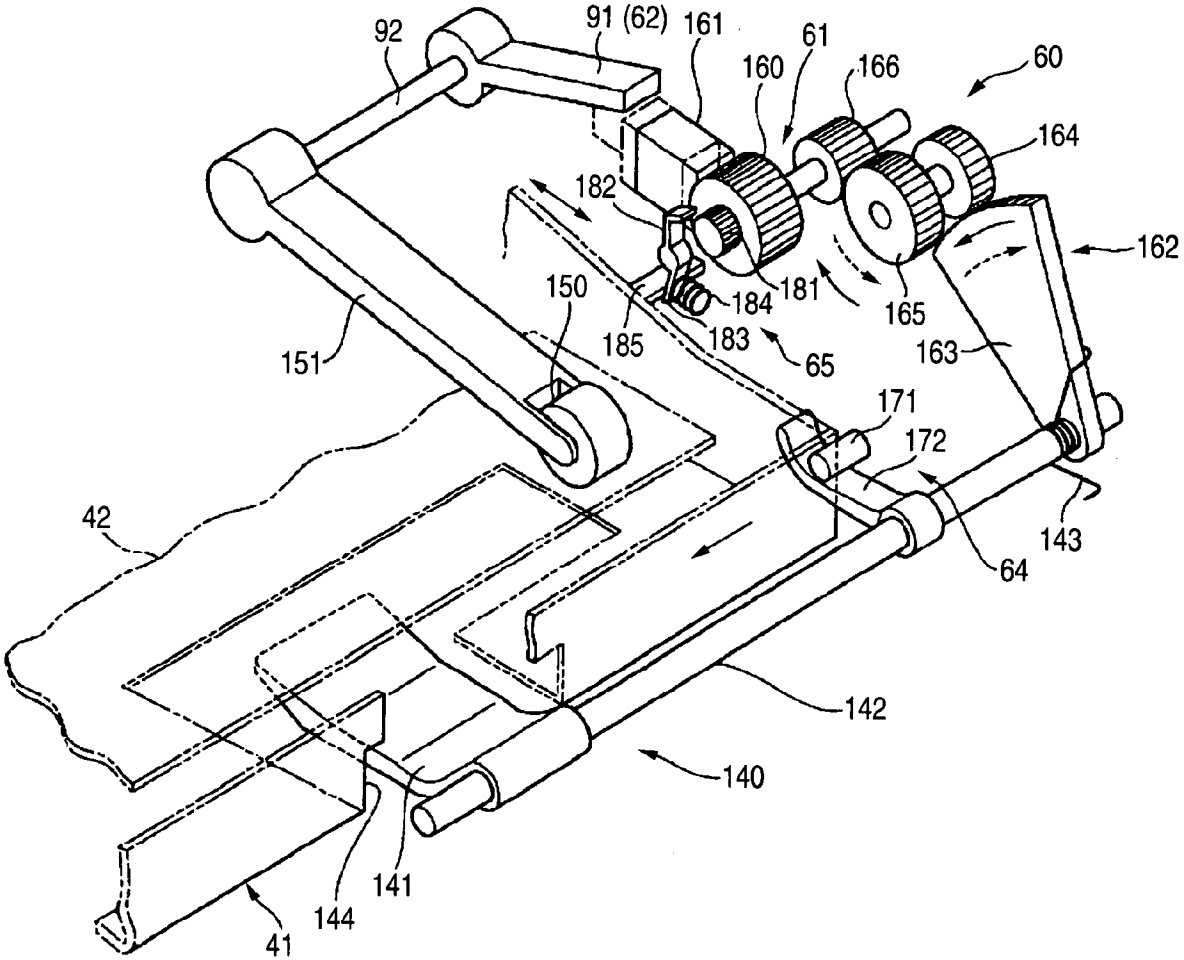
FIG. 19 is an explanatory view showing the main parts of a sheet feeding device according to a second embodiment.

FIG. 19 is an explanatory view showing the main parts of a second embodiment of a sheet feeding device.

In FIG. 19, the sheet feeding device is, substantially similarly to that of the first embodiment, one in which sheets (not shown) on the bottom plate 42 are successively sent from above by the sheet feeding unit 45 (see FIG. 4). However, in contrast to the first embodiment, an elastically urged swinging arm mechanism 140 is adopted as a support structure for the bottom plate 42, and a roller member 150 that moves following the stacking amount of the sheets is separately disposed to configure the interlocking mechanism 60 corresponding to the swinging arm mechanism 140.

In the present embodiment, the bottom plate 42 is disposed at the bottom portion of the sheet tray 41, and the swinging arm mechanism 140 that lifts up the sheet sending direction side of the bottom plate 42 is disposed at the sheet sending direction side of the sheet tray 41 of the tray receiving portion of the apparatus body. The swinging arm mechanism 140 is one in which a cutout 144 is disposed in part of the bottom portion and sheet sending direction side vertical wall of the sheet tray 41, a swinging arm 141 that uses a swinging shaft 142 as a swinging support point is disposed, and this swinging arm 141 is lifted and urged upward by an urging spring 143, whereby the sheet sending direction side of the bottom plate 42 is lifted up.

Also, the roller member 150 is supported by a swinging support arm 151, and is disposed so as to contact the sheets on the bottom plate 42 due to its own self-weight.

The interlocking mechanism 60 includes the restraining mechanism 61 that restrains the movement of the bottom plate 42 in accordance with the stacking amount of the sheets S so that the position of the uppermost sheet S1 of the stack of sheets S stacked on the sheet tray 41 is held at a substantial constant; the release mechanism 62 that interlocks with the movement of the roller member 150 to release the restrained state-resulting from the restraining mechanism 61; the return mechanism 64 that returns the bottom plate 42 to the return position; and the lock mechanism 65 that fixes the bottom plate 42 at the return position.

In the present embodiment, the restraining mechanism 61 is one in which an engagement gear 160 that moves in accordance with the position of the swinging arm 141 of the swinging arm mechanism 140—in other words, the position corresponding to the position of the bottom plate 42—is disposed, a restraining rack 161 that meshes with the engagement gear 160 is disposed so as to be able to move back and forth along a straight locus in a substantially horizontal direction, and the restraining rack 161 is pushed and urged towards the engagement gear 160 by an unillustrated urging spring.

In the present example, the engagement gear 160 transmits the rotation of the swinging shaft 142 of the swinging arm mechanism 140 via a gear transmission system 162. Here, the gear transmission system 162 is one in which a substantially fan-shaped swinging rack 163 is fixed to the swinging shaft 142, a first transmission gear 164 that meshes with the swinging rack 163 is disposed, a second transmission gear 165 is disposed coaxially with the first transmission gear 164, a third transmission gear 166 is disposed coaxially with the engagement gear 160, the third transmission gear 166 and the second transmission gear 165 are made to mesh together, and the engagement gear 160 is moved up and down.

Figure 20:
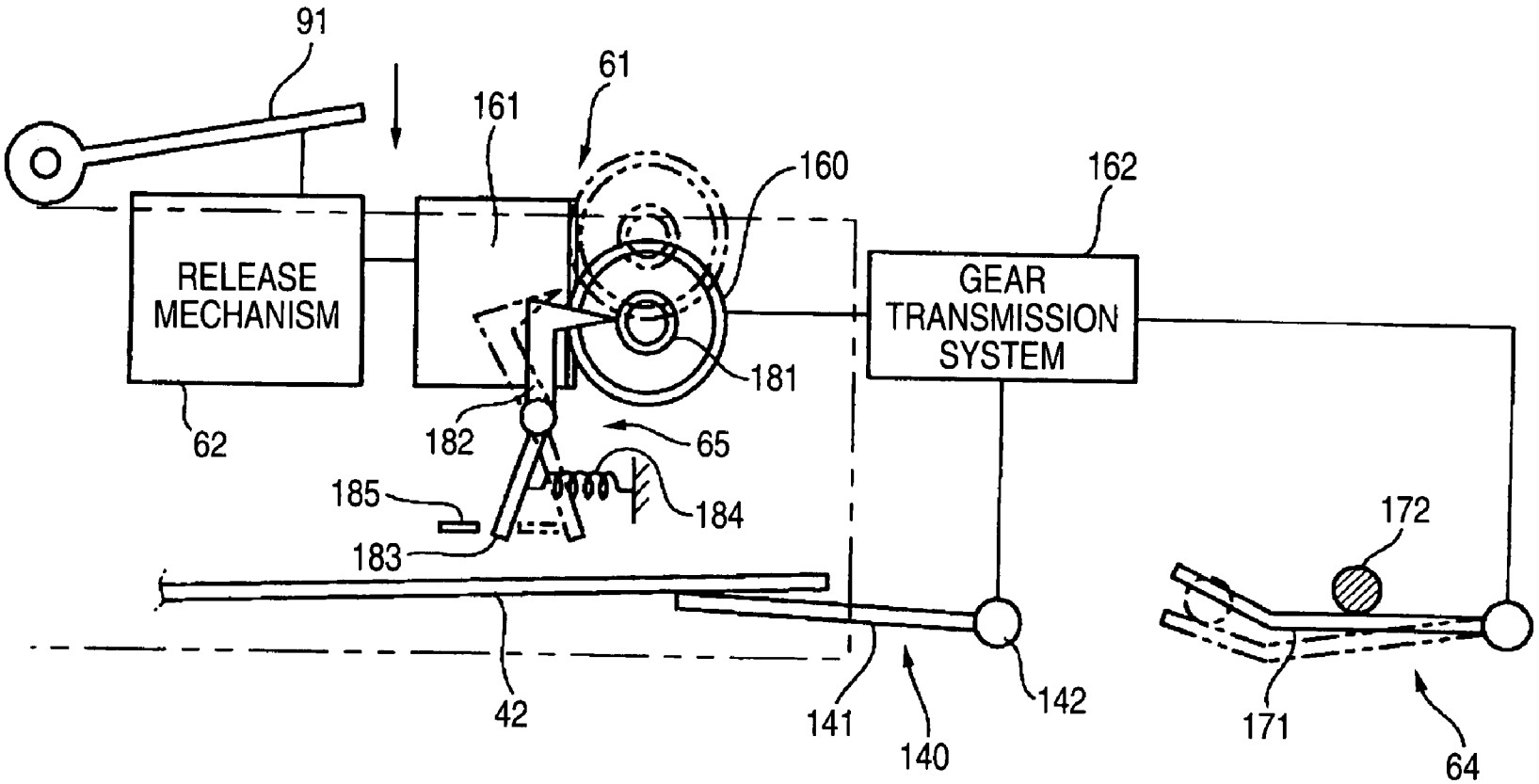
FIG. 20 is an explanatory view schematically showing the sheet feeding device according to the second embodiment.

Also, as shown in FIGS. 19 and 20, although the release mechanism 62 is configured in substantially the same manner as in the first embodiment, a release lever 91 having a swinging shaft 92 coaxial with the swinging support arm 151 of the roller member 150 is used as an operational portion of the release mechanism 62. The release lever 91 interlocks and swings with the roller member 150 to push down the release knob 80 (see FIG. 6) of the release mechanism 62.

Moreover, in the present embodiment, the return mechanism 64 is one in which a return engagement pin 171 is formed so as to protrude from part of the side wall of the sheet tray 41, a cam arm 172 including a predetermined cam surface is fixed to the swinging shaft 142 of the swinging arm mechanism 140, the swinging arm 141 of the swinging arm mechanism 140 is moved to a lowermost position when the sheet tray 41 is pulled out from the device body due to the engagement between the return engagement pin 171 and the cam arm 172, whereby the bottom plate 42 is returned to the return position.

Moreover, the lock mechanism 65 in regard to the return mechanism 64 is one where a lock engagement gear 181 serving as a locked member is disposed coaxially with the engagement gear 160, and a lock pawl 182 that engages with and disengages from the lock engagement gear 181 is disposed.

In the present embodiment, the lock pawl 182 swings using the swinging shaft as a support point. A locking piece 183 is formed so as to protrude from the swinging shaft portion of the lock pawl 182. The locking piece 183 is pushed and urged by an urging spring 184 so that the lock pawl 182 is continually pushed against the lock engagement gear 181.

A lock release pin 185 is formed so as to protrude from the side wall of the sheet tray 41. In a state where the sheet tray 41 has been completely loaded into the tray receiving portion of the device body, the lock release pin 185 engages with the locking piece 183 to thereby release the meshed state between the lock pawl 182 and the lock engagement gear 181.

Thus, according to the present embodiment, when the sheets are successively fed by the unillustrated sheet feeding unit, the sheets stacked on the bottom plate 42 are gradually reduced.

In the present embodiment, the roller member 150 is lowered from a predetermined position and the release lever 91 is lowered in accompaniment therewith to push down the release knob 80 of the release mechanism 62, whereby the restraining rack 161 is caused to retreat and release the restrained state of the engagement gear 160.

In so doing, the engagement gear 160 becomes free to rotate, the swinging arm 141 of the swinging arm mechanism 140 is lifted up by the urging force of the urging spring 143, and the bottom plate 42 is lifted up in accompaniment therewith.

At this time, the roller member 150 is pushed upwards via the sheets stacked on the bottom plate 42 and the release lever 91 is also pushed upwards in accompaniment therewith. Thus, the release knob 80 contacting the release lever 91 also rises upward due to the urging force of the unillustrated urging spring.

In this state, the restraint release state of the restraining mechanism 61 resulting from the release mechanism 62 is released and the restraining rack 161 moves towards and engages with the engagement gear 160 to restrain the rotation of the engagement gear 160.

At this stage, the position of the swinging arm 141 of the swinging arm mechanism 140 becomes restrained and the position of the bottom plate 42 is restrained in accompaniment therewith. For this reason, the position of the uppermost sheet of the sheet stacked on the bottom plate 42 is continually held at a substantial constant and the sheet sending operation resulting from the sheet feeding unit 45 is conducted stably.

Also, in the present embodiment, when the sheet tray 41 runs out of sheets and sheets are to be set, the sheet tray 41 may be pulled out from the device body.

At this time, the return mechanism 64 (the return engagement pin 171 and the cam arm 172) acts in accompaniment with the pullout operation of the sheet tray 41 to move the swinging arm 141 of the swinging arm mechanism 140 to the lowermost position (return position), whereby the bottom plate 42 is returned to the return position (position at the bottom portion of the sheet tray 41).

In this state, the lock mechanism 65 (the lock engagement gear 181 and the lock pawl 182) acts to restrain the rotation of the engagement gear 160 and fix the swinging arm 141 of the swinging arm mechanism 140 in the return position.

When the sheet tray 41 has been pulled out to the pullout position, the bottom plate 42 is placed on the bottom portion of the sheet tray 41 due to its own self-weight so that setting of the sheets is conducted smoothly.

Next, when the set sheet tray 41 is inserted and loaded in the device body, the swinging arm 141 of the swinging arm mechanism 140 continues to be restrained in the lowermost position due to the action of the lock mechanism 65. Thus, the bottom plate 42 of the inserted sheet tray 41 and the swinging arm mechanism 140 do not interfere with one another.

Additionally, in a state where the sheet tray 41 has been completely loaded into the tray receiving portion of the device body, the lock release pin 185 of the sheet tray 41 strikes the locking piece 183 so that the locked state resulting from the lock mechanism 65 is released. For this reason, the locked state of the swinging arm mechanism 140 becomes released, the bottom plate 42 is lifted up to the lift-up position by the swinging arm mechanism 140, the sheets on the bottom plate 42 are disposed so as to contact the pickup roll 46 of the sheet feeding unit 45 and the sheet sending preparations are concluded.

It should be noted that by disposing a one-way clutch (not shown) inside the engagement gear 160, the swinging arm 141 of the swinging arm mechanism 140 can be rotated to the lowermost position (return position) even if the restraint resulting from the restraining mechanism 61 is not released.

Also, in the present embodiment, the restraining rack 161 of the restraining mechanism 61 is configured to move along a straight locus in a substantially horizontal direction so as to engage with and disengage from engagement gear 160. However, it is not necessary for the restraining rack 161 to always move along a straight locus. It suffices as long as, for example, the restraining rack 161 at least moves along a straight locus near the portion where the restraining rack 161 and the engagement gear 160 are engaged.

Figure 21:
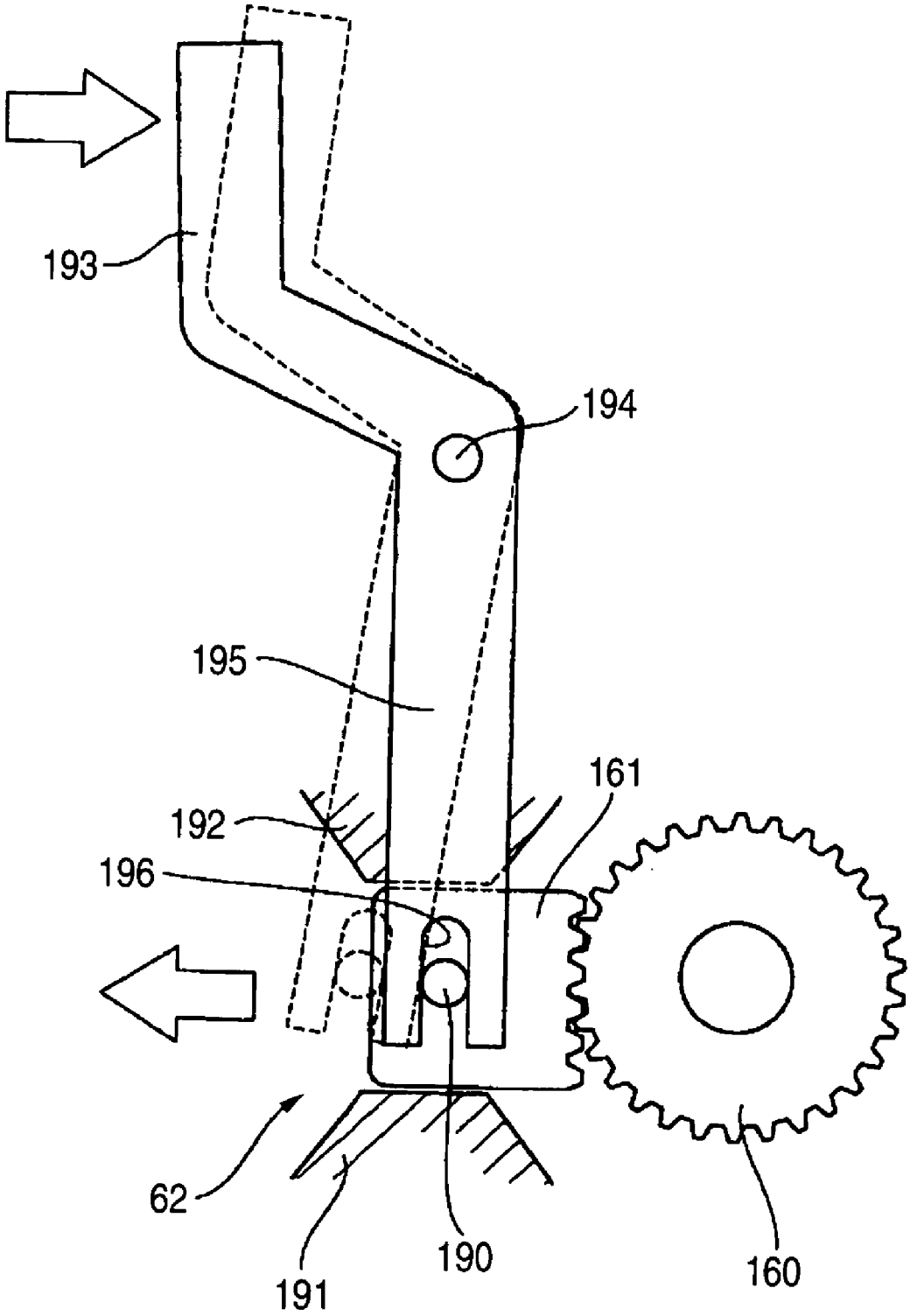
FIG. 21 is an explanatory view showing a modified mode of the release mechanism used in the second embodiment.

As the movement system of this type of restraining rack 161, a system is adopted in which, as shown for example in FIG. 21, the straight locus of the restraining rack 161 is regulated by guide members 191 and 192, an engagement pin 190 is formed so as to protrude from the restraining rack 161, and, as the components of the release mechanism 62, a link arm 193 using a swinging shaft 194 as a support point is disposed, an engagement arm 195 that interlocks with the swinging of the link arm 193 is disposed, a U-shaped engagement groove 196 is formed in a free end of the engagement arm 195, and the engagement pin 190 slidably engages with the engagement groove 196.

According to this system, when the link arm 193 is pushed and moved in the direction of the arrow by, for example, an unillustrated release lever, the engagement arm 195 swings around the swinging shaft 194. However, the restraining rack 161 moves along a partially straight locus due to the engaged state having play between the engagement groove 196 and the engagement pin 190.

Third Embodiment

A present embodiment is one in which the invention is applied to a front-loading type sheet feeding device.

Figure 22:
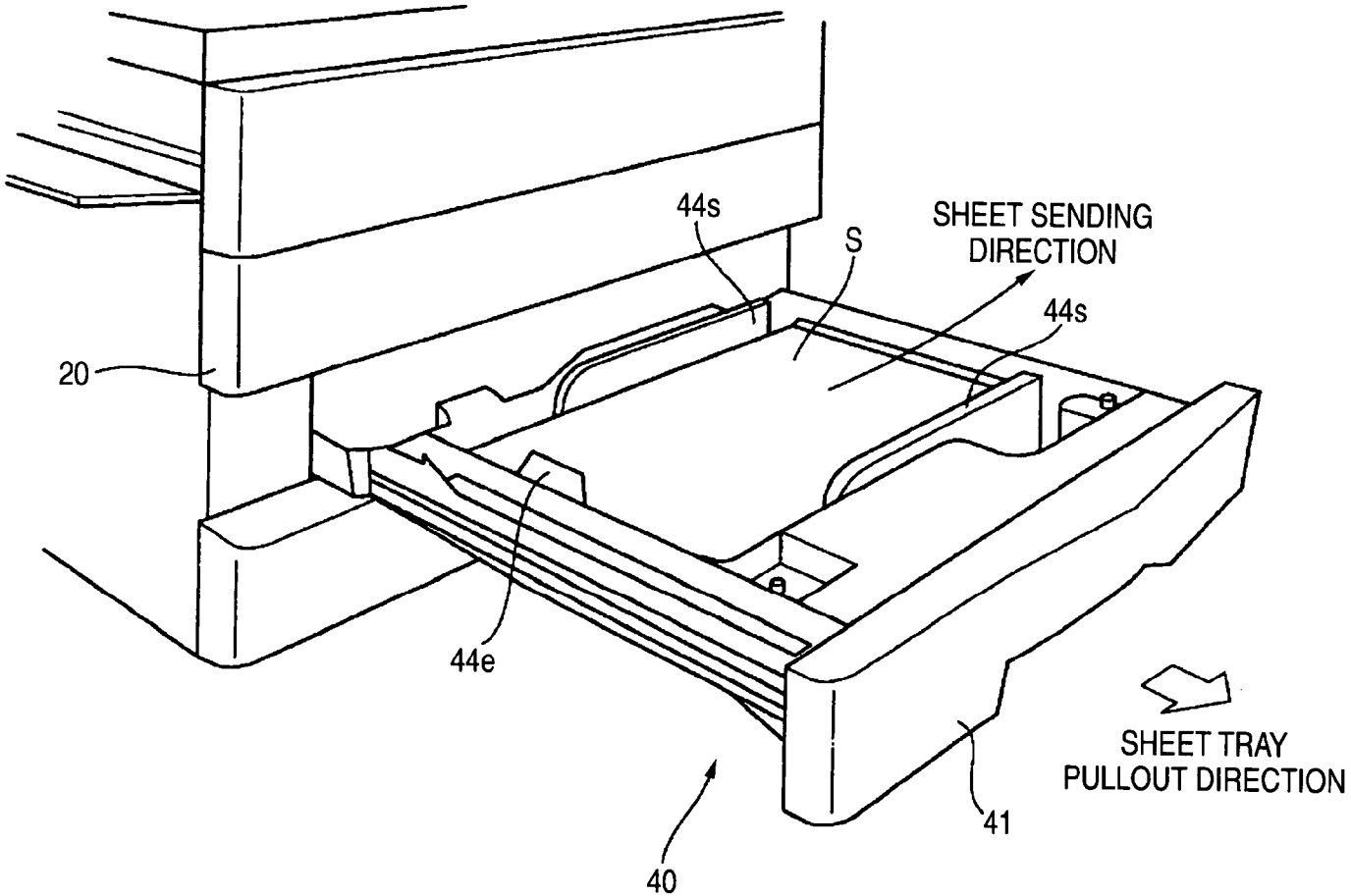
FIG. 22 is an explanatory view showing an overall sheet feeding device according to a third embodiment.

FIG. 22 is a diagram showing an overall front-loading type sheet feeding device.

In FIG. 22, the sheet tray 41 is loaded into the device body 22 so that it can be pulled out from the front. Side guides 44*s* and an end guide 44*e* that position the sheets S are disposed in the sheet tray 41. The sheets S are sent from a direction orthogonal to the direction in which the sheet tray 41 is pulled out.

Figure 23:
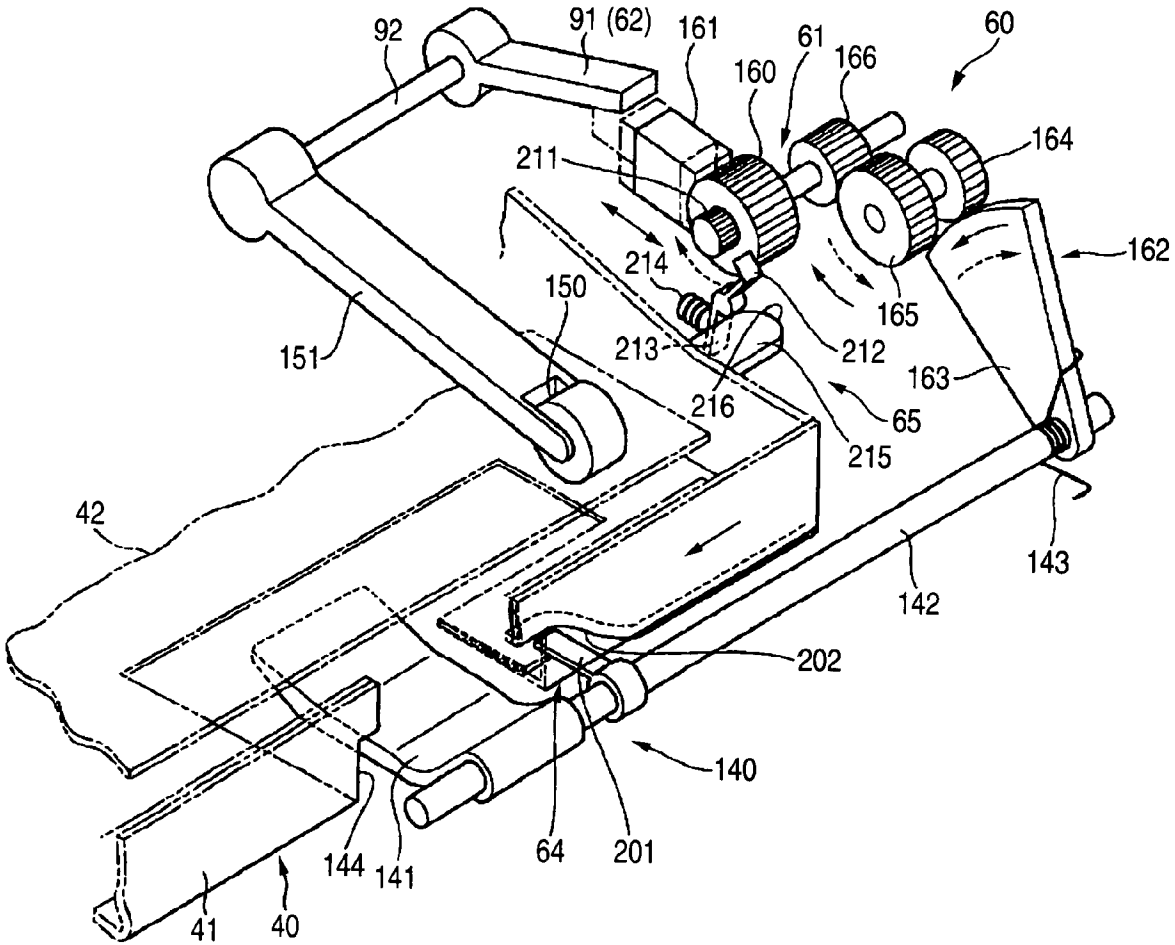
FIG. 23 is an explanatory view showing the main parts of the sheet feeding device according to the third embodiment.

In the present embodiment, as shown in FIG. 23, the basic configuration of the sheet feeding device includes substantially the same swinging arm mechanism 140 and roller member 150 as in the second embodiment, and the interlocking mechanism 60 includes substantially the same restraining mechanism 61 and release mechanism 62 as in the second embodiment, but the return mechanism 64 and the lock mechanism 65 of the interlocking mechanism 60 are different from those of the second embodiment. It should be noted that the same reference numerals as in the second embodiment will be given to constituent elements that are the same as those of the second embodiment, and that detailed description thereof will be omitted here.

In the present embodiment, the return mechanism 64 is one in which a return engagement pin 201 is fixed to the swinging shaft 142 of the swinging arm mechanism 140, and a cam groove 202 of a predetermined shape with which the return engagement pin 201 engages is formed in the sheet sending direction side wall of the sheet tray 41. The cam groove 202 is formed in a shape that pushes the return engagement pin 201 down to the lowermost position (return position) when the sheet tray 41 is pulled out.

The lock mechanism 65 is one in which a lock engagement gear 211 is disposed coaxially with the engagement gear 160 of the restraining mechanism 61, and a lock pawl 212 that engages with and disengages from the lock engagement gear 211 is disposed.

In the present embodiment, the lock pawl 212 swings using the swinging shaft as a support point, a locking piece 213 is formed so as to protrude from the swinging shaft portion of the lock pawl 212, the locking piece 213 is pushed and urged by an urging spring 214, and the lock pawl 212 is continually pushed against the lock engagement gear 211.

A lock release piece 215 is formed so as to protrude from a deep side wall of the sheet tray 41. An end of the lock release piece 215 is formed as an arced guide portion 216. Additionally, in a state where the sheet tray 41 has been completed loaded into the tray receiving portion of the device body, the arced guide portion 216 of the lock release piece 215 strikes the locking piece 213 and the locking piece 213 is moved along the arced guide portion 216 towards the lock release piece 215 to release the meshed state between the lock pawl 212 and the lock engagement gear 211.

Thus, in the present embodiment, substantially similar to the second embodiment, the uppermost sheet of the stack of sheets on the bottom plate 42 is maintained at a substantially constant position due to the action of the restraining mechanism 61 and the release mechanism 62, whereby the sheet sending operation resulting from the sheet feeding unit is stably conducted.

Also, in the present embodiment, when the sheet tray 41 runs out of sheets and sheets are to be set, the sheet tray 41 may be pulled out from the device body.

At this time, the return mechanism 64 (the return engagement pin 201 and the cam groove 202) works in accompaniment with the pullout operation of the sheet tray 41 to return the swinging arm 141 of the swinging arm mechanism 140 to the lowermost position (return position).

In this state, because the engagement gear 160 moves downward, the lock mechanism 65 (the lock engagement gear 211 and the lock pawl 212) works to restrain the rotation of the engagement gear 160 and fix the swinging arm 141 of the swinging arm mechanism 140 in the return position.

Next, when the set sheet tray 41 is inserted and loaded in the device body, the swinging arm 141 of the swinging arm mechanism 140 continues to be restrained in the lowermost position due to the action of the lock mechanism 65. Thus, the bottom plate 42 of the inserted sheet tray 41 and the swinging arm mechanism 140 do not interfere with one another.

Additionally, in a state where the sheet tray 41 has been completely loaded into the tray receiving portion of the device body, the lock release piece 215 of the sheet tray 41 strikes the locking piece 213 so that the locked state resulting from the lock mechanism 65 is released. For this reason, the locked state of the swinging arm mechanism 140 becomes released, the bottom plate 42 is lifted up to the lift-up position by the swinging arm mechanism 140, the sheets on the bottom plate 42 are disposed so as to contact the pickup roll of the sheet feeding unit and the sheet sending preparation are concluded.

Fourth Embodiment

Figure 24:
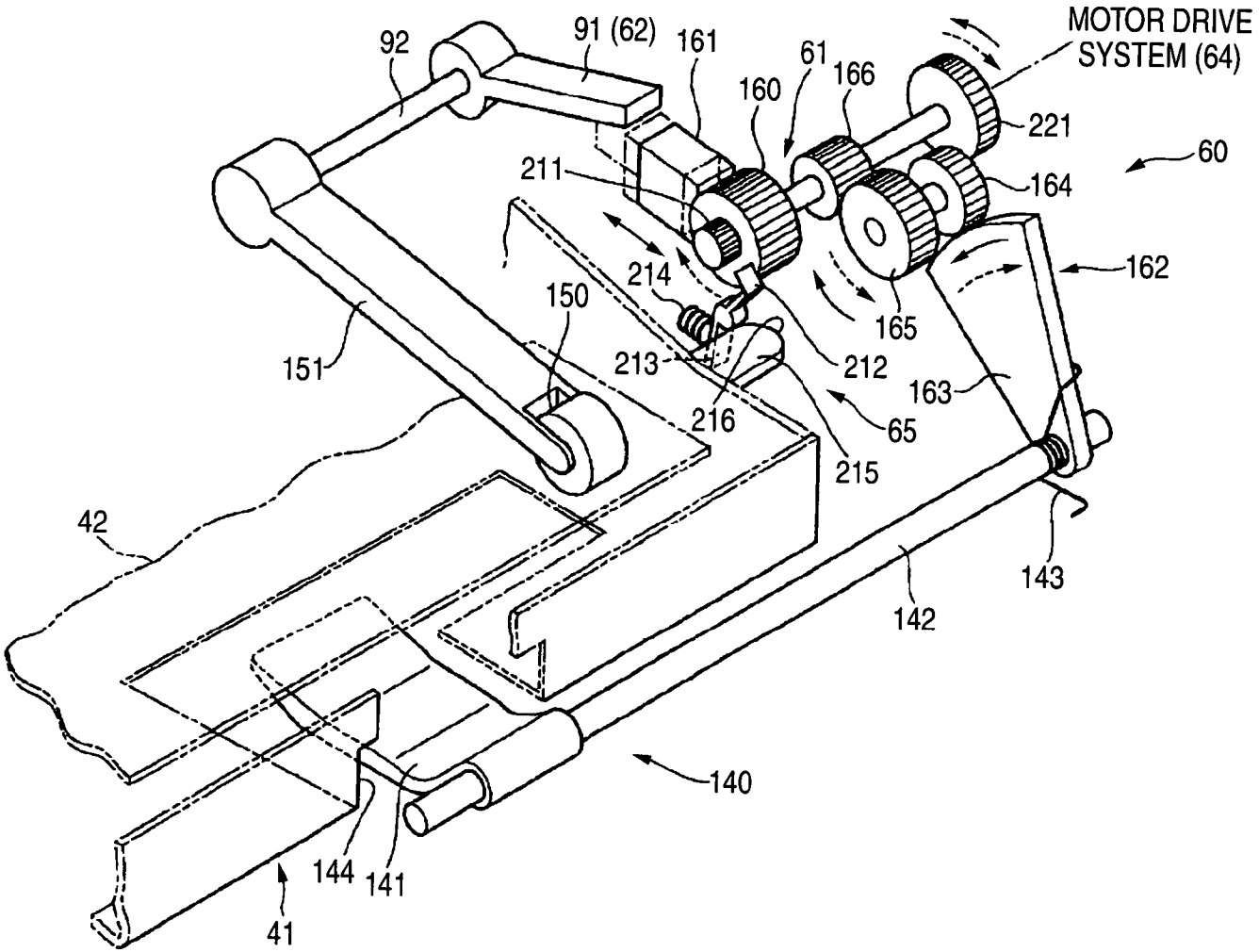
FIG. 24 is an explanatory view showing the main parts of a sheet feeding device according to a fourth embodiment.

FIG. 24 is an explanatory view showing a fourth embodiment of the sheet feeding device to which the invention is applied.

In FIG. 24, the basic configuration of the sheet feeding device is substantially the same as that of the third embodiment, but the configuration of the return mechanism 64 of the interlocking mechanism 60 is different from that of the third embodiment. It should be noted that the same reference numerals as in the third embodiment will be given to constituent elements that are the same as those of the third embodiment, and that detailed description thereof will be omitted here.

In the present embodiment, the return mechanism 64 is realized by a motor drive system.

Figure 25:
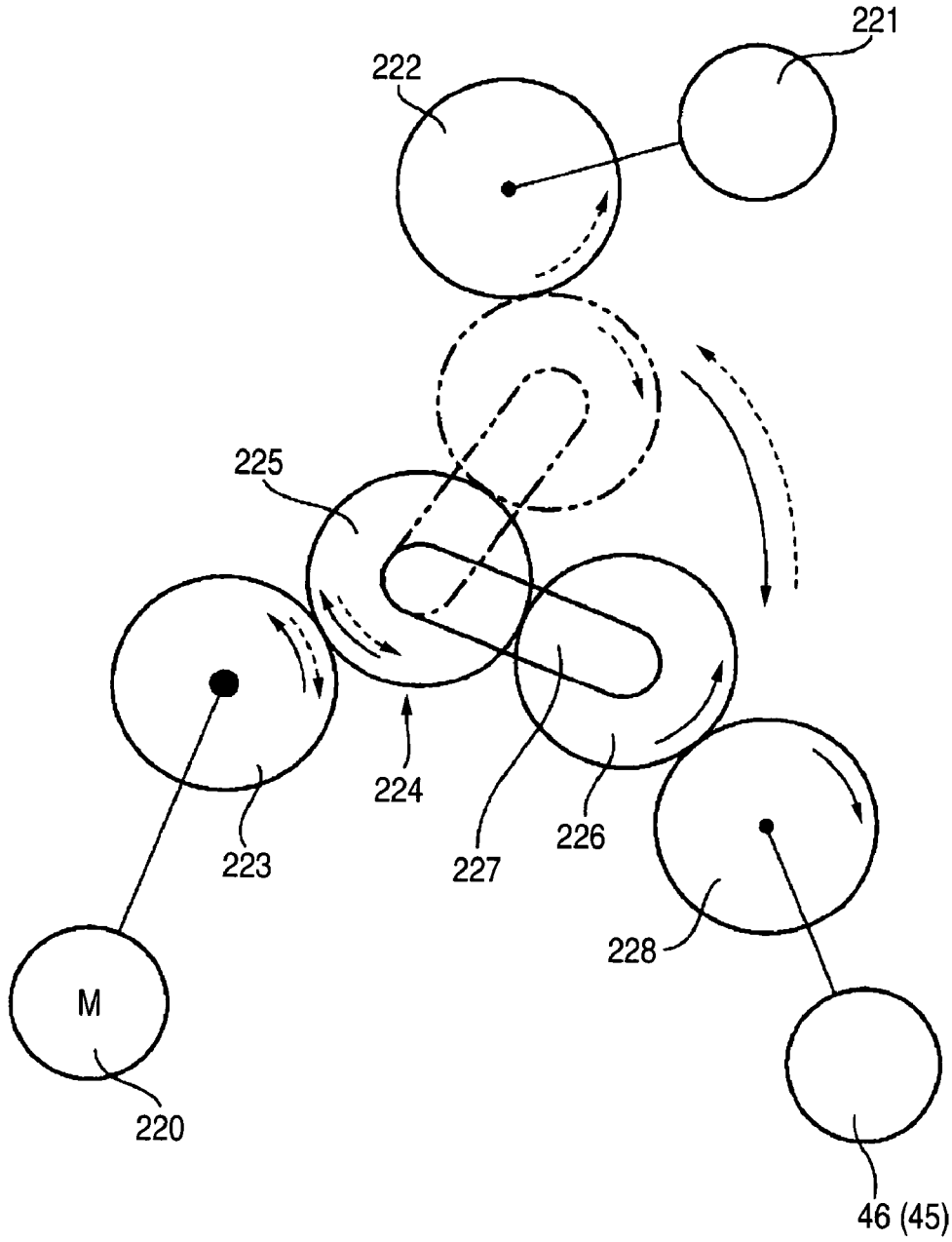
FIG. 25 is an explanatory view showing a motor drive system of the sheet feeding device according to the fourth embodiment.

As shown in FIGS. 24 and 25, the motor drive system is one which includes a feed motor 220 for driving the sheet feeding unit and in which a return transmission gear 221 is disposed coaxially with the engagement gear 160 of the restraining mechanism 61, a first switching gear 222 is made to mesh with the return transmission gear 221, a drive transmission gear 223 is disposed at the feed motor 220, a second switching gear 228 is disposed at the pickup roll 46 of the sheet feeding unit 45, and a pendulum gear 224 equipped with a fixed gear 225, which meshes with the drive transmission gear 223, and a swinging gear 226, which meshes with the fixed gear 225 and in which the shafts are coupled with a swinging arm 227 is intervened between the drive transmission gear 223, the first switching gear 222 and the second switching gear 228.

In the present embodiment, a gear train is configured so that, when the feed motor 220 is forwardly rotated, the pendulum gear 224 swings downward due to the rotation of the drive transmission gear 223 as shown by the solid line in FIG. 25, and the swinging gear 226 meshes with the second switching gear 228. For this reason, the driving force from the feed motor 220 is transmitted to the pickup roll 46 of the sheet feeding unit 45.

It should be noted that, when the feed motor 220 is forwardly rotating, the driving force from the feed motor 220 is not transmitted to the restraining mechanism 61 or the release mechanism 62, and that the driving force of the restraining mechanism 61 and the release mechanism 62 is based entirely on the elastic force of an unillustrated urging spring.

Conversely, the gear train is configured so that, when the feed motor 220 is reversely rotated, the pendulum gear 224 swings upward due to the rotation of the drive transmission gear 223 as shown by the dotted line in FIG. 25, and the swinging gear 226 meshes with the first switching gear 222. For this reason, the driving force from the feed motor 220 is transmitted to the engagement gear 160 via the drive transmission gear 223, the pendulum gear 224, the first switching gear 222 and the return transmission gear 221, and the engagement gear 160 is moved to the lowermost position.

For this reason, the swinging arm 141 of the swinging arm mechanism 140 returns to the lowermost position (return position).

It should be noted that the return position of the swinging arm mechanism 140 can be adjusted by controlling the rotational amount when the feed motor 220 is reversely rotated. Also, because the feed motor 220 functions separately between the case where it acts as the return mechanism 64 and the case where it acts as the drive source of the sheet feeding unit 45, an excessive load does not act on the feed motor 220.

Fifth Embodiment

A present embodiment is one in which the invention is applied to a manual-feed type sheet feeding device.

Figure 26:
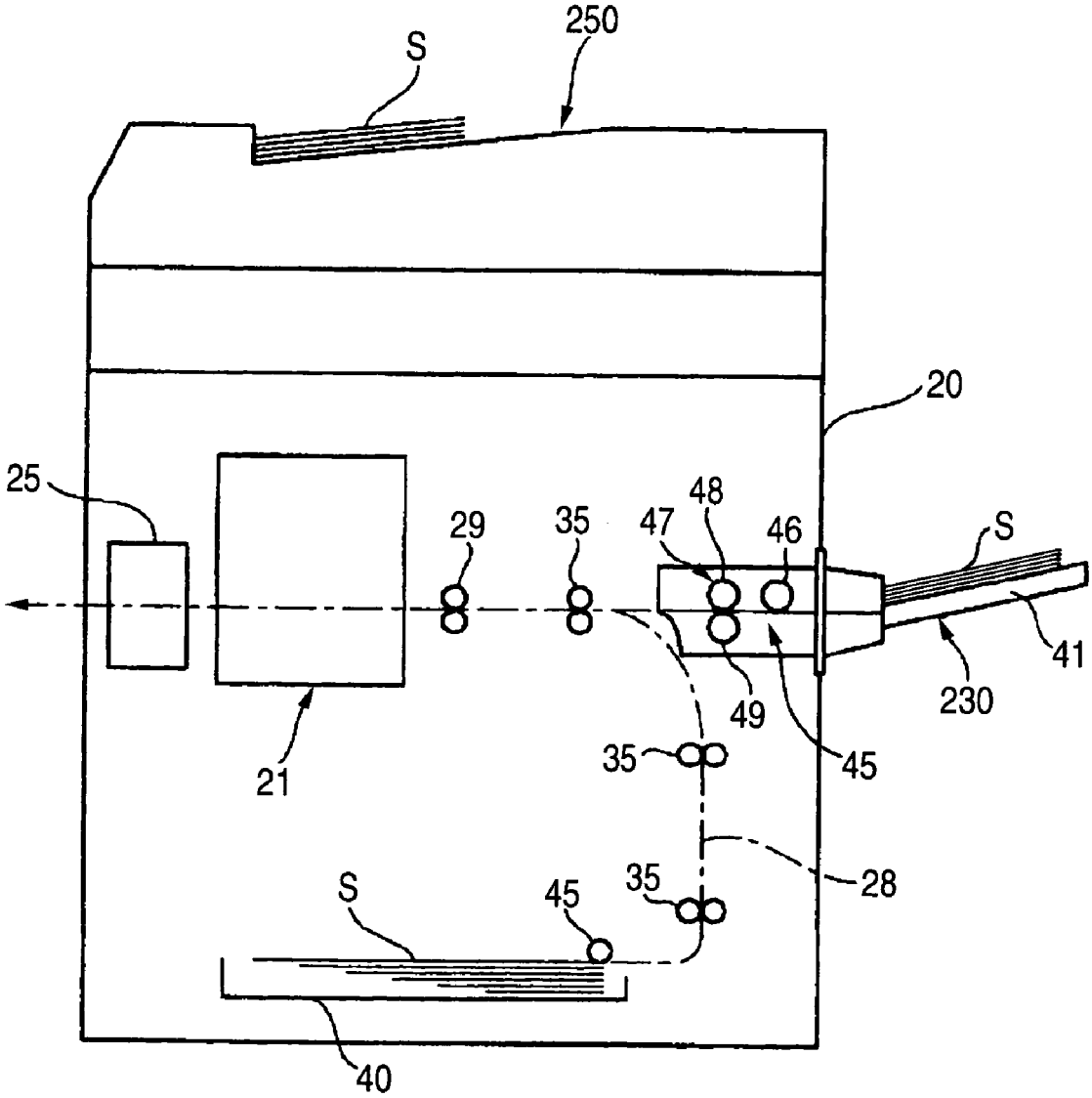
FIG. 26 is an explanatory view showing a sheet processing apparatus into which a sheet feeding device according to a fifth embodiment is incorporated.

FIG. 26 shows an example in which a manual-feed type sheet feeding device 230 is incorporated in a sheet processing apparatus.

In FIG. 26, reference numeral 40 represents a pullout type sheet feeding device, and sheets S from this sheet feeding device 40 are discharged after passing through the sheet conveyance path 28, the imaging engine 21 and the fixing device 25. In the drawings, reference numeral 29 represents registration rolls and reference numeral 35 represents conveyance rolls.

Figure 27:
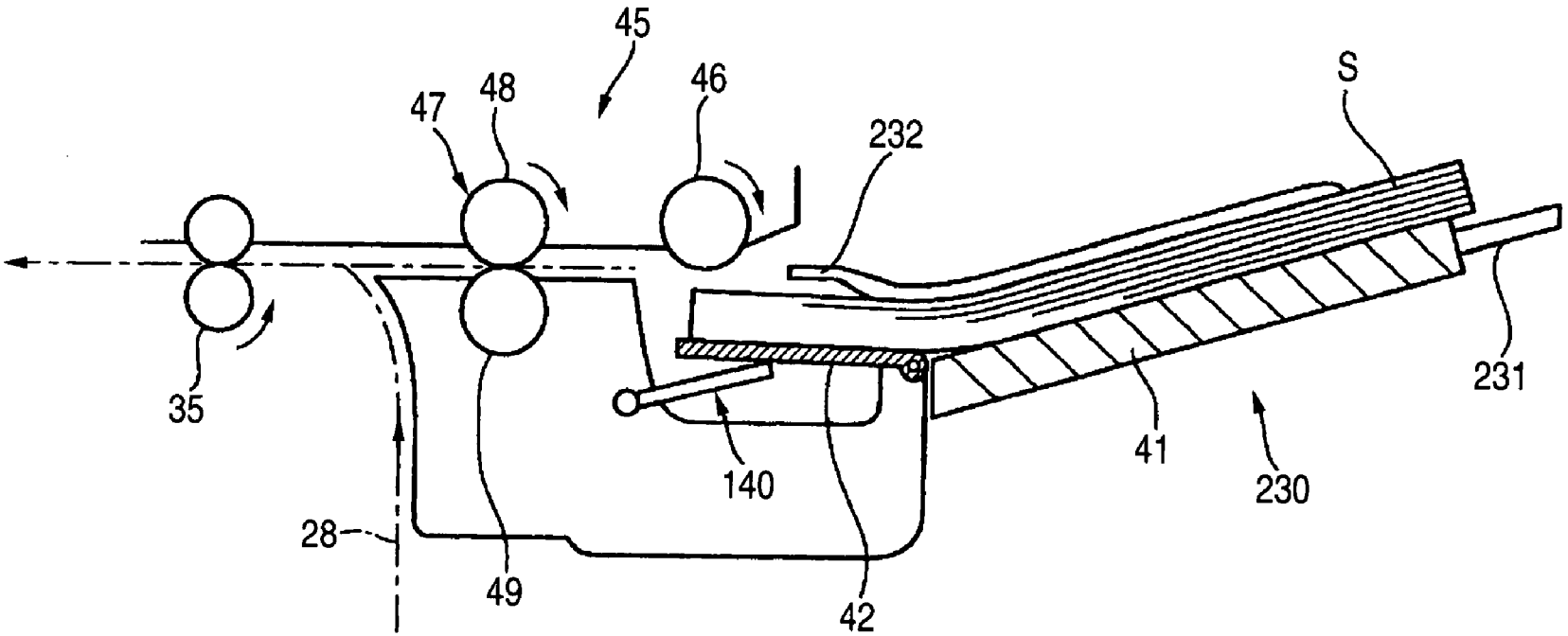
FIG. 27 is an explanatory view showing an overall manual-feed type sheet feeding device in the fifth embodiment.

Also, as shown in FIGS. 26 and 27, the manual-feed type sheet feeding device 230 is configured so that, in contrast to the pullout type sheet feeding device 40, the sheet tray 41 is fixedly disposed, the bottom plate 42 is disposed in the sheet tray 41, and the bottom plate 42 is lifted up by the swinging arm mechanism 140. In the drawings, reference numeral 231 represents an operational lever for opening and closing the sheet tray 41, reference numeral 232 represents a holding cover that holds down the sheets S stacked on the sheet tray 41, and reference numeral 45 represents the sheet feeding unit (disposed with the pickup roll 46 and the separating mechanism 47 (feed roll 48 and retard roll 49)).

In the present embodiment, the restraining mechanism 61, the release mechanism 62 and the return mechanism 64 (configured by a motor drive system) of the interlocking mechanism 60 are substantially the same as those of the fourth embodiment, but the lock mechanism 65 is different from that of the fourth embodiment.

Figure 28:
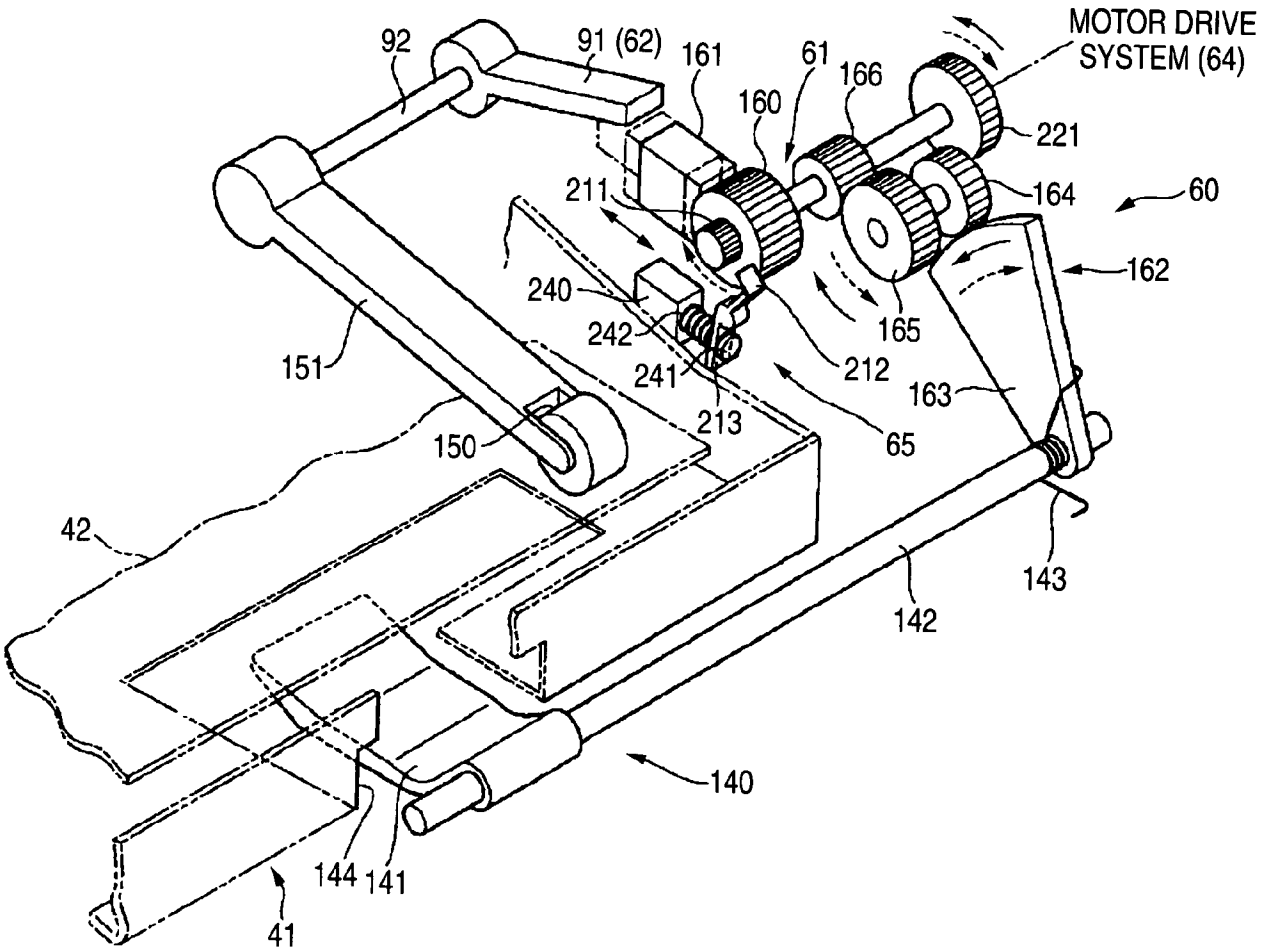
FIG. 28 is an explanatory view showing the main parts of the manual-feed type sheet feeding device in the fifth embodiment.

In the present embodiment, the lock mechanism 65 is one in which, as shown in FIG. 28, a lock engagement gear 211 is disposed coaxially with the engagement gear 160 of the restraining mechanism 61, and a lock pawl 212 that engages with and disengages from the lock engagement gear 211 is disposed. In the present embodiment, the lock pawl 212 swings using a swinging shaft as a support point, and a locking piece 213 is formed so as to protrude from the swinging shaft portion of the lock pawl 212.

Also, a plunger 241 of a solenoid 240 is coupled to the locking piece 213, and a compression spring 242 is attached to the plunger 241.

In the present example, when the solenoid 240 is turned on and the plunger 241 is sucked in, the lock pawl 212 is separated from the lock engagement gear 211 and the locked state of the lock engagement gear 211 resulting from the lock pawl 212 is released. Conversely, when the plunger 241 is returned, the lock pawl 212 locks the lock engagement gear 211 due to the urging force of the compression spring 242.

Figure 29:
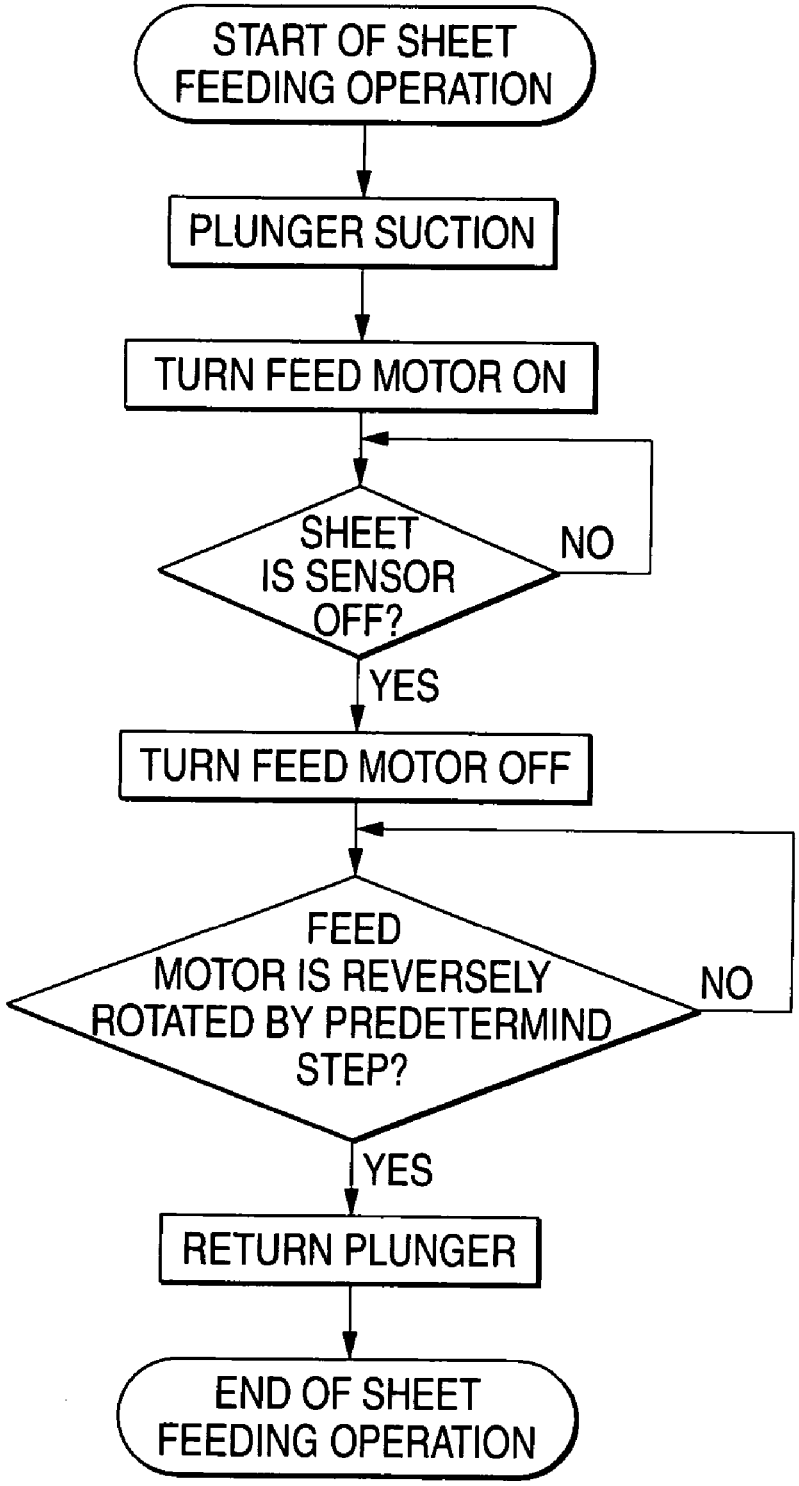
FIG. 29 is a flow chart showing the movement process resulting from the return mechanism in the fifth embodiment.

In the present embodiment, the return mechanism 64 and the lock mechanism 65 operate as shown in FIG. 29. Namely, when the sheet feeding operation begins, first, the solenoid 240 acts to suck in the plunger 241. In this state, the locked state resulting from the lock mechanism 65 is released.

Thereafter, the feed motor 220 (see FIG. 25) of the motor drive system is turned on by forward rotation and the sheet feeding operation is carried out.

Then, when the fact that the sheet tray 41 has run out of sheets is detected by a sheet sensor, the feed motor 220 is turned off and driven to reversely rotate by a predetermined step, and the swinging arm mechanism 140 is returned to the return position. Thereafter, the plunger 241 of the solenoid 240 is returned to end the sheet feeding operation.

Figure 30:
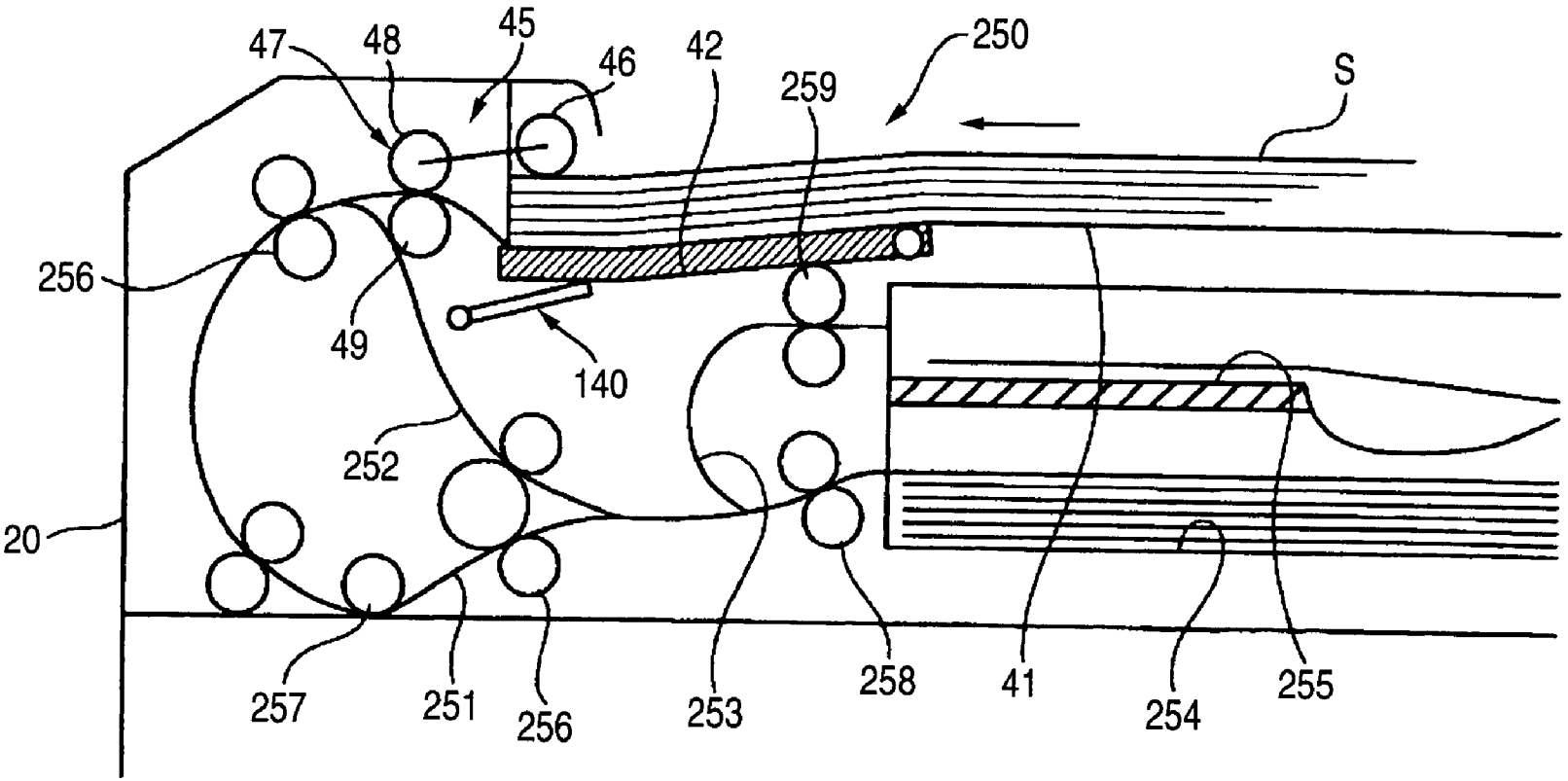
FIG. 30 is an explanatory view showing a modified mode of the sheet feeding device in the fifth embodiment.

Also, although an example was described in the present embodiment in which the invention was applied to the manual-feed type sheet feeding device 230, the invention is not limited thereto and can be applied to a document feeding device 250 as shown in FIGS. 26 and 30.

As shown, for example, in FIG. 30, this type of document feeding device 250 is one in which the bottom plate 42 is disposed in the sheet tray 41 and the bottom plate 42 is lifted up by the swinging arm mechanism 140. The interlocking mechanism 60 shown in FIG. 28 may also be disposed.

In FIG. 30, reference numeral 45 represents the sheet feeding unit, reference numeral 46 represents the pickup roll and reference numeral 47 represents the separating mechanism (configured by the feed roll 48 and the retard roll 49). Also, reference numerals 251 to 253 represent conveyance paths along which documents serving as the sheets S are conveyed, reference numerals 254 and 255 represent document discharge trays, reference numerals 256 represent conveyance rolls, reference numeral 257 represents a pressing roll of a document reading section, and reference numerals 258 and 259 represent discharge rolls that discharge the documents into the discharge trays 254 and 255.

As was described above, according to the invention, a system using an elastic support member includes a restraining mechanism that restrains the elastic support member in accordance with a stacking amount of sheets so that the position of the uppermost sheet of a stack of sheets stacked on a sheet tray is held at a substantial constant and a release mechanism that release the restrained state resulting from the restraining mechanism in association with the movement of following movable members. Thus, the nipping pressure of a sheet feeding member with respect to the uppermost sheet can be held at a substantial constant without using a drive source and a driving force transmission mechanism. For this reason, the sheet sending operation can be stabilized with a simple configuration.

In particular, in the invention, the structure of the restraining mechanism is devised to include an engagement member that moves together with the elastic support member and a restraining member that restrains the movement of this engagement member. The restraining member moves along a straight locus near an engaging portion of both so as to engage with and disengage from the engagement member. Thus, restraining and releasing operations between the restraining member and the engagement member can be stabilized, the reliability of operation with respect to the restraining mechanism and the release mechanism can be improved as a result, and stabilization of the sheet sending operation can be reliable realized.

Also, according to the sheet processing apparatus in which the sheet feeding device is incorporated, the sheet sending operation can be stabilized with a simple configuration. Thus, a sheet processing apparatus whose sheet feeding capability is excellent can be reliably constructed.

In particular, in the invention, because the return mechanism that returns the elastic support member to the return position that is a lift-up initial position of the stack of sheets resulting from the elastic support member, e.g., by causing the return mechanism to work when the sheets are set (setting the sheets in the sheet tray, setting the sheet tray housing the sheets in the device body, etc.), a situation where the elastic support member is lifted up when the sheets are set can be effectively circumvented, and the ability of the sheets to be set can be excellently maintained.

Moreover, by adding the return position fixing mechanism by which the elastic support member is releasably fixed at the return position, it becomes possible to hold the return mechanism is a fixed state even, for example, if the release mechanism is inadvertently operated when the sheets are set and the restrained state resulting from the restraining mechanism is released. For this reason, the return operation of the return mechanism resulting from inadvertent operation can be effectively circumvented and, as a result, there is no potential for the operability of the sheets to be compromised due to inadvertent operation.

Also, according to the sheet processing apparatus in which this sheet feeding device is incorporated, the sheet sending operation can be stabilized and the sheets settability of the sheets can be excellently maintained with a simple configuration. Thus, a sheet processing apparatus whose sheet feeding capability is excellent can be reliably constructed.

What is claimed is:

1. A sheet feeding device comprising:

a sheet tray on which sheets are stacked;

an elastic support member that lifts up and supports, with an elastic force of an elastic member, the stack of sheets stacked on the sheet tray;

a sheet feeding unit that successively feeds, beginning with an uppermost sheet, the stack of sheets lifted up by the elastic support member;

a following movable member which is disposed so as to contact the uppermost sheet of the stack of sheets stacked on the sheet tray and which follows and moves in accordance with a change in the stacking amount of the sheets;

a restraining mechanism that restrains the elastic support member in accordance with the stacking amount of the sheets so that the position of the uppermost sheet of the stack of sheets stacked on the sheet tray is held at a substantially constant position, the restraining mechanism including an engagement member that is disposed on the elastic support member and moves together with the elastic support member and a restraining member that restrains the movement of the engagement member; and a release mechanism that interlocks with the movement of the following movable member to release the restrained state resulting from the restraining mechanism;

wherein the restraining member moves along a straight locus at least in the vicinity of an engaging portion between the engagement member and the restraining member so as to engage with and disengage from the engagement member.

2. The sheet feeding device according to claim 1, wherein the following movable member comprises a sheet feeding member disposed so as to contact the uppermost sheet of the stack of sheets stacked on the sheet tray.

3. The sheet feeding device according to claim 1, wherein the following movable member comprises a rotating body that is rotatable.

4. The sheet feeding device according to claim 1, wherein the engagement member comprises a gear in which teeth are formed at least on part of a peripheral surface thereof; and the restraining member comprises a rack on which at least one tooth that meshes with the gear is formed.

5. The sheet feeding device according to claim 1, wherein the restraining member comprises at least two driving portions at at least two places that simultaneously drive the restraining member when the restraining member is moving.

6. The sheet feeding device according to claim 5, further comprising an urging member disposed at the restraining member.

7. The sheet feeding device according to claim 4, wherein the teeth of the gear and the rack are involute teeth having a pressure angle of 8 to 12 degrees.

8. The sheet feeding device according to claim 1, wherein the release mechanism comprises:

a release operational member that moves together with the following movable member;

a contact interlocking member that abuts against and interlocks with the release operational member; and a coupling member that is disposed between the contact interlocking member and the restraining mechanism and releasably couples the restraining mechanism.

9. The sheet feeding device according to claim 8, wherein the coupling member comprises a gear train that meshes with a driving portion of the restraining mechanism, with the contact interlocking member being coupled to one of the gears of the gear train.

10. The sheet feeding device according to claim 9, wherein in the gear train, the number of teeth of each gear is set so that a rotational force of a gear coupled to the contact interlocking member is amplified and transmitted to the driving portion of the restraining mechanism.

11. The sheet feeding device according to claim 1, further comprising a guide mechanism by which the movement of the elastic support member is guided.

12. The sheet feeding device according to claim 11, wherein the restraining mechanism comprises the engagement member disposed at the elastic support member and having a gear that moves together with the elastic support member, and the restraining member having a rack that restrains the movement of the engagement member;

the guide mechanism comprises a guide gear that is disposed separately from the gear of the restraining mechanism at the elastic support member, and a guide rack that meshes with the guide gear and guides the locus of movement of the elastic support member; and the gear of the restraining mechanism has a smaller diameter than the guide gear.

13. The sheet feeding device according to claim 1, wherein the engagement member is attached to the elastic support member via a one-way clutch.

14. The sheet feeding device according to claim 1, further comprising a buffer member in which a buffering force is imparted to the movement of the elastic support member;

wherein the buffer member is attached to the elastic support member via a one-way clutch.

15. The sheet feeding device according to claim 13, wherein coupling of the one-way clutch is cut when the elastic support member is lowered.

16. The sheet feeding device according to claim 14, wherein coupling of the one-way clutch is cut when the elastic support member is lowered.

17. The sheet feeding device according to claim 1, wherein the sheet feeding unit comprises a sheet feeding member and a separating mechanism that separates, one sheet at a time, the sheets fed by the sheet feeding member.

18. The sheet feeding device according to claim 1, further comprising a return mechanism that returns the elastic support member to a return position that is a lift-up initial position of the stack of sheets.

19. The sheet feeding device according to claim 18, wherein the return mechanism comprises a return-use engagement member at the elastic support member and a pushdown mechanism by which the return-use engagement member is forcibly pushed down.

20. The sheet feeding device according to claim 18, further comprising the sheet tray that can be pulled out from an apparatus body;

wherein the return mechanism interlocks with the pulling out of the sheet tray from the apparatus body to return the elastic support member to the return position.

21. The sheet feeding device according to claim 19, further comprising the sheet tray that can be pulled out from an apparatus body;

wherein the pushdown mechanism comprises a cam that is disposed at the apparatus body, interlocks with the pulling out of the sheet tray from the apparatus body, engages with the return-use engagement member and forcibly pushes down the return-use engagement member.

22. The sheet feeding device according to claim 18, further comprising a return position fixing mechanism that releasably fixes the elastic support member at the return position.

23. The sheet feeding device according to claim 22, wherein the return position fixing mechanism comprises:

a return engagement member that is disposed at the elastic support member and moves together with the elastic support member;

a return restraining member that restrains the movement of the return engagement member with the condition that the elastic support member has reached the return position; and a return release member that releases the restrained state resulting from the return restraining member.

24. The sheet feeding device according to claim 23, wherein the return engagement member comprises a gear where teeth are formed at least on part of a peripheral surface thereof; and the return restraining member comprises a rack on which at least one tooth that meshes with the gear is formed.

25. The sheet feeding device according to claim 24, wherein the return restraining member moves along a straight locus at least in the vicinity of an engaging portion between the restraining member and the return engagement member so as to engage with and disengage from the return engagement member.

26. The sheet feeding device according to claim 24, wherein the teeth of the rack that is the return restraining member and the gear that is the return engagement member are sawtooth-like gear teeth.

27. The sheet feeding device according to claim 23, wherein the return release member acts on the return restraining member in a state when the sheet tray is loaded into an apparatus body.

28. The sheet feeding device according to claim 23;

wherein the return release member comprises a protruding member that is disposed at an apparatus body and releases the restrained state of the return restraining member in a state where the sheet tray has been loaded in the apparatus body.

29. The sheet feeding device according to claim 18, further comprising a guide mechanism by which the locus of movement of the elastic support member is guided.

30. The sheet feeding device according to claim 29, wherein the comprises a gear that moves together with the elastic support member, and the restraining member further comprises a rack that restrains the movement of the engagement member;

the guide mechanism comprises a guide gear that is disposed, separately from the gear of the restraining mechanism, at the elastic support member and a guide rack that meshes with the guide gear and guides the locus of movement of the elastic support member; and the module of the gear that is the engagement member of the restraining mechanism is set to be smaller than that of the guide gear.

31. A sheet processing apparatus comprising:

a sheet processing section; and a sheet feeding device including:

a sheet tray on which sheets are stacked;

an elastic support member that lifts up and supports, with an elastic force of an elastic member, the stack of sheets stacked on the sheet tray;

a sheet feeding unit that successively feeds, beginning with an uppermost sheet, the stack of sheets lifted up by the elastic support member;

a following movable member disposed so as to contact the uppermost sheet of the stack of sheets stacked on the sheet tray and which follows and moves in accordance with a change in the stacking amount of the sheets;

a restraining mechanism that restrains the elastic support member in accordance with the stacking amount of the sheets so that the position of the uppermost sheet of the stack of sheets stacked on the sheet tray is held at a substantially constant height, the restraining mechanism including an engagement member that moves together with the elastic support member and a restraining member that restrains the movement of the engagement member; and a release mechanism that interlocks with the movement of the following movable member to release the restrained state resulting from the restraining mechanism;

wherein the restraining member moves along a straight locus at least in the vicinity of an engaging portion between the engagement member and the restraining member so as to engage with and disengage from the engagement member.

* * * * *